US008235237B1

(12) United States Patent
Stravitz

(10) Patent No.: US 8,235,237 B1
(45) **Date of Patent: *Aug. 7, 2012**

(54) WASTE DISPOSAL DEVICE WITH SELF-CLOSING LID

(76) Inventor: David M Stravitz, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/161,764

(22) Filed: Jun. 16, 2011

Related U.S. Application Data

(63) Continuation-in-part of application No. 12/637,252, filed on Dec. 14, 2009, now Pat. No. 7,963,414.

(60) Provisional application No. 61/138,209, filed on Dec. 17, 2008.

(51) Int. Cl.
*B65D 43/26* (2006.01)

(52) U.S. Cl. ..... 220/264; 220/263; 220/495.07; 220/908.1

(58) Field of Classification Search ..... 220/263, 220/264, 495.07, 495.08, 908.1
See application file for complete search history.

(56) References Cited

U.S. PATENT DOCUMENTS

| | | | |
|---|---|---|---|
| 2,946,474 | A | 7/1960 | Knapp |
| 4,470,220 | A | 9/1984 | Sudo |
| 4,576,252 | A | 3/1986 | Omata |
| 5,125,526 | A | 6/1992 | Sumanis |
| 5,444,877 | A | 8/1995 | Kumarasurier |
| 5,794,277 | A | 8/1998 | Jones |
| 6,024,238 | A | 2/2000 | Jaros |
| 6,128,890 | A | 10/2000 | Firth |
| 6,145,283 | A | 11/2000 | Noordenbos |
| 6,370,847 | B1 | 4/2002 | Jensen et al. |
| 6,561,055 | B1 | 5/2003 | Turk |
| 6,612,099 | B2 | 9/2003 | Stravitz |
| 6,626,316 | B2 | 9/2003 | Yang |
| 6,719,194 | B2 | 4/2004 | Richards |
| 6,804,930 | B2 | 10/2004 | Stravitz |
| 6,851,251 | B2 | 2/2005 | Stravitz |
| 7,114,314 | B2 | 10/2006 | Stravitz |
| 7,146,785 | B2 | 12/2006 | Stravitz |
| 7,316,100 | B2 | 1/2008 | Stravitz et al. |
| 7,374,060 | B2 | 5/2008 | Yang et al. |
| 7,434,377 | B2 | 10/2008 | Stravitz et al. |
| 7,503,152 | B2 | 3/2009 | Stravitz et al. |
| 7,503,159 | B2 | 3/2009 | Stravitz et al. |
| 7,617,659 | B2 | 11/2009 | Stravitz et al. |
| 7,963,414 | B1 * | 6/2011 | Stravitz ..... 220/264 |

* cited by examiner

*Primary Examiner* — Harry Grosso
(74) *Attorney, Agent, or Firm* — Brian Roffe

(57) ABSTRACT

Waste disposal device that receives a waste-containing member includes a container defining a waste-receiving compartment having an opening, a lid having a closed position covering the opening and an open position in which the opening is exposed, and a rotation mechanism arranged in the container to rotate the waste-containing member when present. The rotation mechanism is arranged to rotate the waste-containing member upon closure of the lid without manual handling of the lid. A foot pedal assembly includes a depressible foot pedal and a spring, and is arranged to cause both opening of the lid when the foot pedal is depressed and closure of the lid when the pressing force is removed. The spring is moved against its bias upon depression of the foot pedal and returns to its original state when the pressing force is removed to thereby cause closure of the lid and rotation of the waste-containing member.

28 Claims, 30 Drawing Sheets

WASTE DISPOSAL DEVICE WITH SELF-CLOSING LID

CROSS-REFERENCE TO RELATED APPLICATIONS

This application is a continuation-in-part of U.S. patent application Ser. No. 12/637,252 filed Dec. 14, 2009, which claims priority under 35 U.S.C. §119(e) of U.S. provisional patent application Ser. No. 61/138,209 filed Dec. 17, 2008, both of which are incorporated by reference herein.

FIELD OF THE INVENTION

The present invention relates generally to waste disposal devices into which waste products are placed and more particularly to waste disposal devices having a lid which is opened to enable insertion of waste into an interior of the container and automatically closes to thereby cover the interior of the container. More specifically, the invention relates to waste disposal devices that includes a rack and pinion assembly that is coupled to the lid and a twisting mechanism so that as the lid automatically closes, the twisting assembly causes a twist or knot to form in the bag or tubing above the inserted waste.

BACKGROUND OF THE INVENTION

Small waste disposal devices are common in hospitals, doctors' offices and other locations where waste is generated and must be disposed of in a sanitary manner. Further, if the waste emits odors, the waste disposal device should also contain odors emanating from the waste.

Some waste disposal devices include a lid which is coupled to a gear mechanism whereby upon forced manual closure of the lid, the gear mechanism converts the manually-initiated closing movement of the lid into rotation of a twisting mechanism which engages with a length of tubing or a plastic bag in the waste disposal device to thereby cause formation of a twist in the tubing or bag. The twist is situated above the waste products in the tubing or bag so that emanation of odors from the waste products in the container is reduced. Such waste disposal devices are disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188 and 7,712,285, all of which are incorporated by reference herein.

A drawback of such waste disposal devices is that closure of the lid is manually initiated so that the person throwing out the waste product must also come into contact with the lid to urge the lid to close. This contact may be difficult if the person is holding other objects and may also lead to transmission of bacteria from the lid to the person.

It would be desirable to provide a waste disposal device which does not require a person throwing out waste products to manually handle the lid in order to close the lid.

OBJECTS AND SUMMARY OF THE INVENTION

It is an object of the present invention to provide new and improved waste disposal devices including a lid which can be closed without manual initiation or contact and whose closure causes rotation of a waste-containing member in general or more specifically, a twisting mechanism which engages with a length of tubing or a bag in the waste disposal device to thereby form a twist in the tubing or bag.

In order to achieve this object and others, a waste disposal device adapted to receive a waste-containing member in accordance with the invention includes a container defining a waste-receiving compartment having an opening, a lid connected to the container and having a first, closed position covering the opening of the container and a second, open position in which the opening is exposed, and a rotation mechanism arranged in the container to rotate the waste-containing member when present in the container. The rotation mechanism is arranged to rotate the waste-containing member upon closure of the lid without manual handling of the lid.

In one embodiment, the rotation mechanism includes at least one rack gear coupled to the lid at an upper end region thereof and a gear assembly having a first gear in meshing engagement with the rack gear(s), and a second, drive gear in meshing engagement with the waste-containing member and which is rotationally coupled to the first gear. The gear assembly may also include at least one additional gear interposed between the first gear and the second gear to transfer rotation of the first gear to the second gear. The rack gear is arranged such that its downward movement, obtained in a manner described below, causes rotation of the waste-containing member by means of the gear assembly.

The waste disposal device also includes a foot pedal assembly which causes both opening of the lid when depressed and closure of the lid when a pressing force is removed. Specifically, the foot pedal assembly includes a foot pedal which extends outward from a lower region of the container, a horizontal actuating member connected to the foot pedal at a first end region, a rigid vertical actuating member having a slot through which a first projection at the second end of the horizontal actuating member passes and a pivot pin connected to the horizontal actuating member between its ends. An upper end region of the vertical actuating member is coupled to the rack gear(s) which is housed in a frame. The vertical actuating member may be connected to or formed integral with the frame. The foot pedal assembly also includes a spring that extends alongside and/or around the vertical actuating member and is connected at its lower end region to a portion of the container, e.g., a base thereof, and at its upper end region to a second projection extending from the vertical actuating member. The spring is moved against its bias upon depression of the foot pedal and returns to its original state when the pressing force on the foot pedal is removed. Further, the spring is coupled to the rack gear(s) such that when the spring returns to its original state, the spring pulls the rack gear(s) downward and thereby enables or causes closure of the lid and rotation of the waste-containing member.

In one embodiment, the container includes at least one transparent window that enables viewing of an interior of the container. The container may include an access door, in which one or more of the windows are arranged. In another embodiment, the horizontal actuating member is connected to the foot pedal at a first end region and the spring is a compression spring and is part of a spring assembly. The spring assembly also includes a rod around which the spring is positioned, and which rod is attached at a lower end region to the horizontal actuating member and at an upper end region to the rotation mechanism. The rod may be connected to the frame that is pivotally coupled to the lid at an upper end region thereof and on which the rack gear(s) is/are arranged. The rod may include a 90 degree portion which is passed through an aperture in the frame, in which case, a fastening member fastens the 90 degree portion of the rod to the frame. Alternatively, the rod may include a 180 degree, hook portion which is passed through an aperture in the frame to thereby fasten the rod to the frame. Retaining members may be provided to retain upper and lower ends of the spring. In yet another embodiment, the rod includes a portion that extends through a slot in the horizontal actuating member, and is fixed to the horizontal actuating member in a manner to allow this portion to be movable in the slot. In still another embodiment, the rod includes a portion that extends through a hole in the horizontal actuating member and is fixed to the horizontal actuating member.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
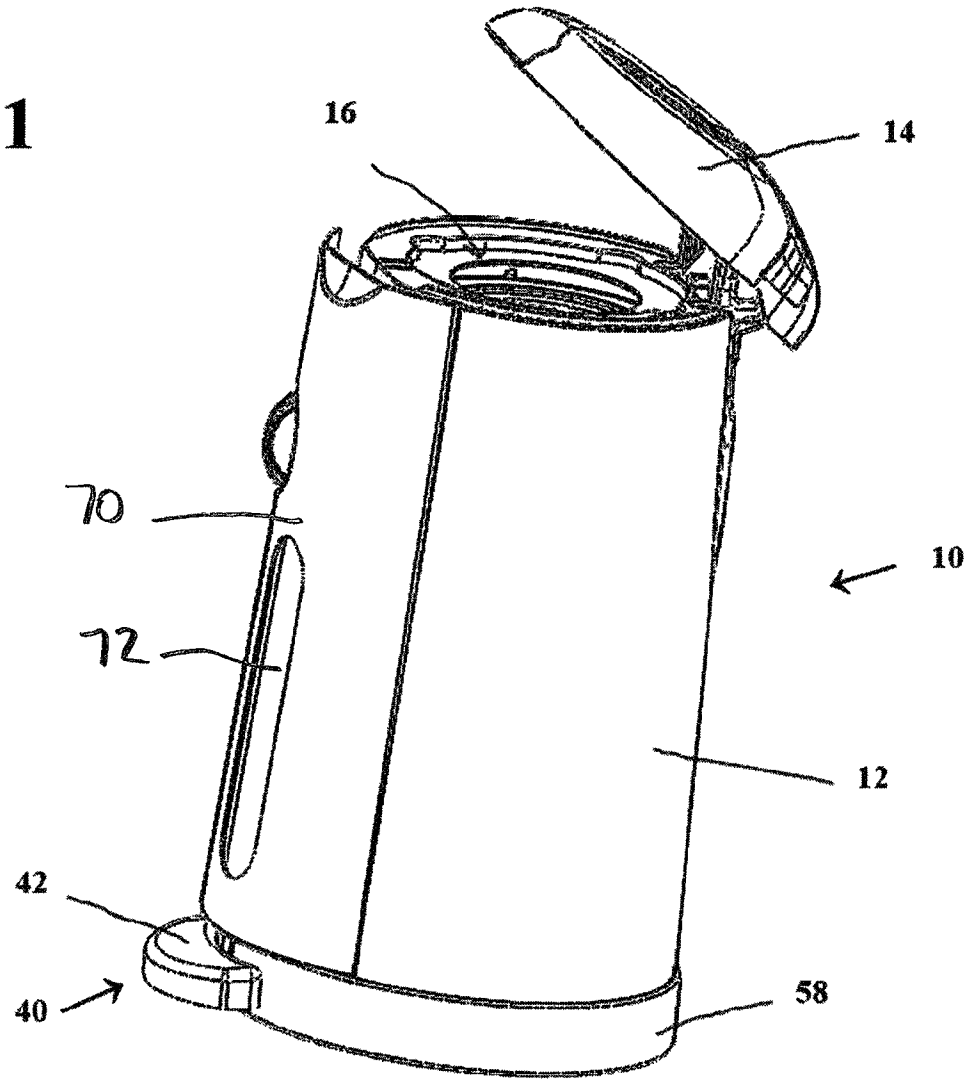
FIG. 1 is a side perspective view of a waste disposal device in accordance with the invention.

Referring to the accompanying drawings wherein like reference numerals refer to the same or similar elements, FIG. 1 shows a waste disposal device in accordance with the invention which is designated generally as 10 and includes a substantially cylindrical container 12 having an outer wall and a base arranged at the lower end region of the outer wall, and which defines a waste-receiving compartment. A lid 14 is pivotally connected to the outer wall so as to be movable between an open position in which a waste insertion opening leading to the waste-receiving compartment is exposed to enable insertion of waste into the container 12 and a closed position in which the lid 14 overlies and closes the waste insertion opening.

A general feature of waste disposal device 10 is that there is rotation of a twisting mechanism 16, only a portion of which is shown in FIG. 1, which engages with tubing or a bag, hereinafter referred to as a waste-containing member, relative to a stationary support or cartridge (not shown) which supports or retains the waste-containing member into which the waste is placed to thereby cause the formation of a twist in the waste-containing member. Rotation of this waste-containing member or the twisting mechanism 16 thereof would occur after insertion of waste to thereby form a twist above the inserted waste and inhibit release of odors from the waste.

To implement this technique, the twisting mechanism 16 is movably seated on a support flange of the container and may have any of several constructions known in the prior art. One such twisting mechanism includes a twisting member having a substantially tubular outer wall, a substantially tubular inner wall, a substantially planar bottom support wall and a circular gear rim adjoining the outer wall and on which projections are formed. The bottom support wall is not contiguous between the outer and inner walls and apertures may be formed therein. The gear rim and its projections may be formed integral or unitary with the twisting member or separate therefrom and then attached thereto.

The twisting mechanism 16 also includes a grasping member such as a membrane 68 (see FIGS. 7 and 9) arranged to engage with waste-containing member. When the twisting mechanism 16 is rotated, the engagement of the membrane with the waste-containing member causes the waste-containing member to be twisted, i.e., form a twist in the waste-containing member. The engagement of the waste-containing member with the membrane arises since the waste-containing member passes through one or more of the slots between fingers of the membrane. The slots define an aperture through which the waste-containing member passes. Note that the waste-containing member may pass through only one slot, or only partially through one slot, or only partially through two or more slots, or only through the center at the intersection of the slots, and the exact manner depends on the actual use of the waste disposal device.

An aperture, through which the waste-containing member passes, may be formed in the membrane by other means, including, barely discernible small slits extending from a frame supporting the outer edge of the membrane to a center. The membrane may be formed and constructed in different ways and is not limited to the presence of six fingers separated by slots. The material of the fingers may be selected to be flexible so that they flex downward in a direction away from the center when a person pushes waste through the central region of the membrane. The material of the fingers should also be resilient so that the fingers return to their initial form after the person has removed their hand from engagement with the membrane, or the inserted waste has been pushed downward through the membrane and is no longer in engagement therewith. For example, the membrane may be made of silicone or another rubbery material. It may also be made of a flexible synthetic material which flexes under pressure and returns when pressure is removed.

The waste-containing member passing through the slots may tend to flex the fingers downward but the fingers will still remain in engagement with the waste-containing member and enable it to be twisted in the manner described below upon rotation of the membrane. The edges of the fingers which are expected to engage the waste-containing member may be provided with a friction-enhancing material to increase the contact force between the fingers and the waste-containing member.

The membrane 68 (see FIGS. 7 and 9) may be formed integral with the twisting member or separate therefrom and then attached thereto. For example, the membrane 68 may include an annular channel on its underside which frictionally engages with an annular projection on the twisting member of the twisting mechanism 16. Friction between the projection on the twisting member of the twisting mechanism 16 and the edges of the channel on the membrane 68 enables the membrane 68 to be securely retained on the twisting member of the twisting mechanism 16 and thus rotated upon and in conjunction with rotation of the twisting member of the twisting mechanism 16.

Any other structure for fixing the membrane to the twisting member to enable them to rotate together may also be used. Instead of the membrane, another form of a grasping member may be used. The general function of such a grasping member is to engage with the waste-containing member as the waste-containing member passes by it and is capable of twisting the waste-containing member when rotated. For example, the grasping member may be a circular frame having fingers extending inwardly therefrom, or have a comparable structure as disclosed in prior art waste disposal devices.

A rotation mechanism 18 is provided to rotate whatever twisting mechanism 16 is arranged in the container 12, upon closure of the lid 14. Rotation mechanism 18 includes a substantially U-shaped rack gear assembly 20 (see, e.g., FIG. 3). The U-shaped rack gear assembly 20 includes a substantially U-shaped frame 22 which is pivotally coupled to the lid 14 at the upper ends of the U-shape via one or more pivot pins 24 (see FIG. 3) and a rack gear 26 on the inside surface of one or both of the legs 28 of the U-shaped frame 22 (see FIGS. 3 and 4). Each rack gear 26 has a series of teeth on at least a portion of a longitudinally extending surface (see FIGS. 3 and 4).

Instead of a U-shaped rack gear assembly 20 having a U-shaped frame 22, a rack gear assembly having a frame with a different form may be used, or a frame may be entirely omitted. Also, only a single elongate rack gear 26 may be provided. Thus, in a waste disposal device in accordance with the invention, there may be at a minimum, only a single rack gear coupled to the lid 14 and which moves vertically in one direction upon opening of the lid 14 and vertically in the opposite direction upon closing of the lid 14.

Figure 2:
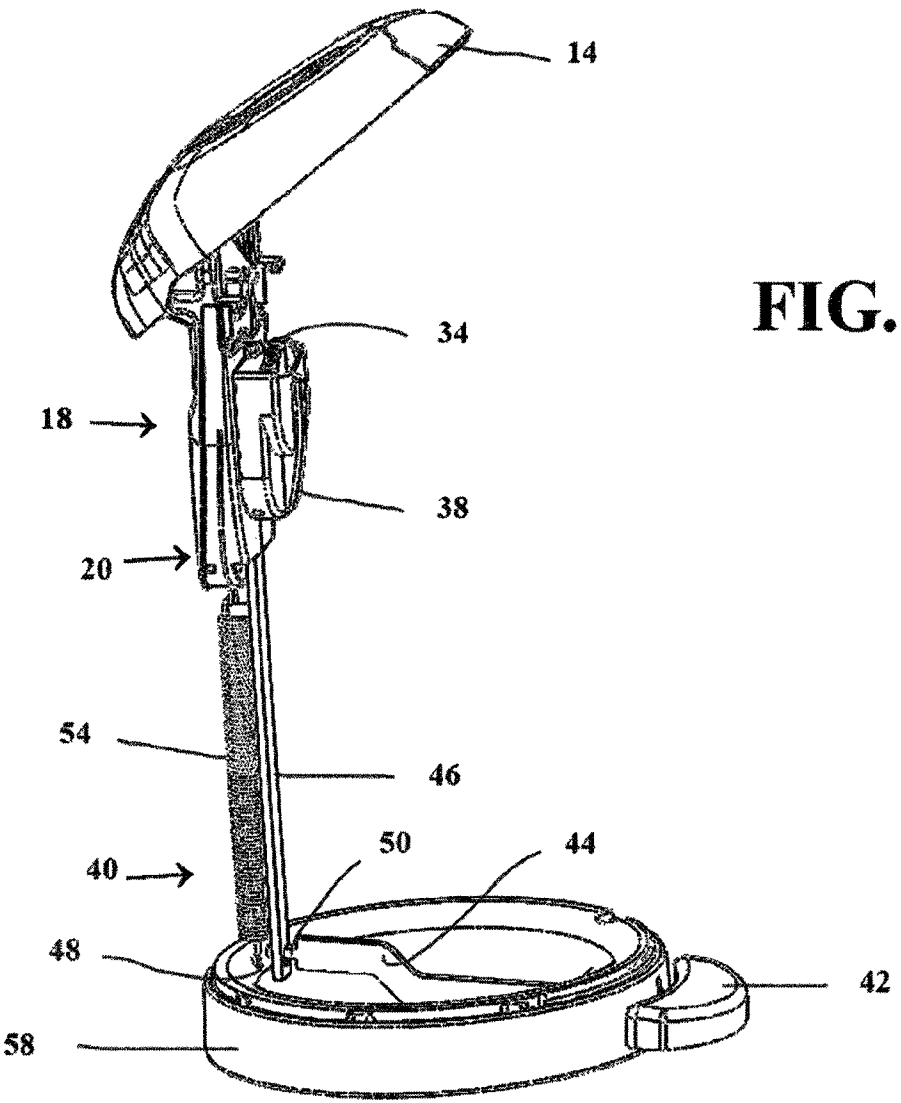
FIGS. 2 and 3 are perspective views of principal parts of the lid movement mechanism in the waste disposal device shown in FIG. 1.

The rotation mechanism 18 also includes a gear assembly 30 (FIGS. 3 and 4) having one gear 32 in meshing engagement with the rack gear 26 (see FIG. 3) and one gear 34 in meshing engagement with the projections on the twisting member (this gear being referred to as the drive gear), and then optionally one or more additional gears 36 interposed between the gear 32 in engagement with the rack gear 26 and the drive gear 34. The gear assembly 30, except for a portion of the drive gear 34 which engages with the twisting member, may be situated in a housing 38 (see FIG. 2).

Gear assembly 30 also includes an appropriate mechanism for enabling one-way transmission of rotational force from the rack gear 26 to the drive gear 34. Such mechanisms are known in the prior art. Other gear assemblies including more or less gears than shown can also be used to convert the downward movement of the rack gear 26 into rotational movement of the drive gear 34 in only a single direction. For example, a bevel gear may be used.

In operation, when the lid 14 is closed, the U-shaped frame 22 and thus the rack gear 26 are moved downward causing rotation of the gears 32, 36 in the gear assembly 30 and ultimately rotation of the drive gear 34. The twisting member of the twisting mechanism 16 is thus caused to rotate in view of the engagement between the projections on the gear rim of the twisting member and the drive gear 34. As such, the closing movement of the lid 14 is converted into rotational movement of the twisting member of the twisting mechanism 16.

Other mechanisms for converting the closing movement of the lid 14 into rotational movement of the twisting member of the twisting mechanism 16 are also contemplated within the scope of the invention and include those known in the prior art.

Figure 11:
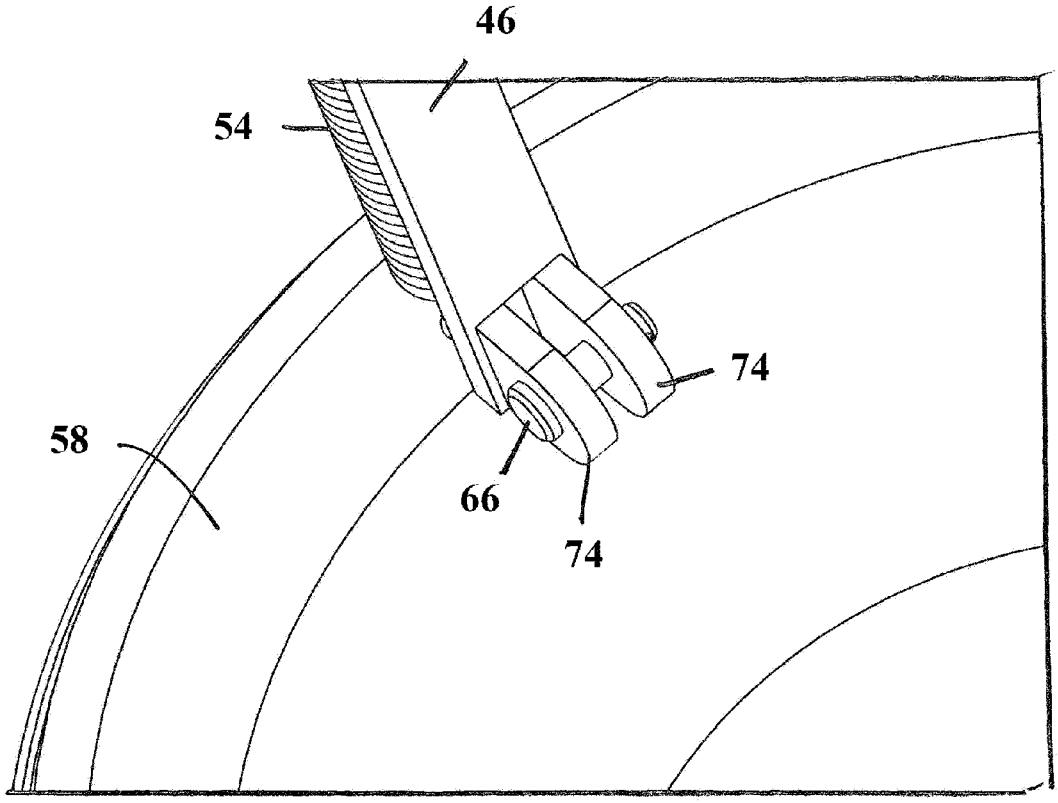
FIG. 11 is a perspective view of part of the base portion of the embodiment of the waste disposal device shown in FIG. 8.
Figure 12:
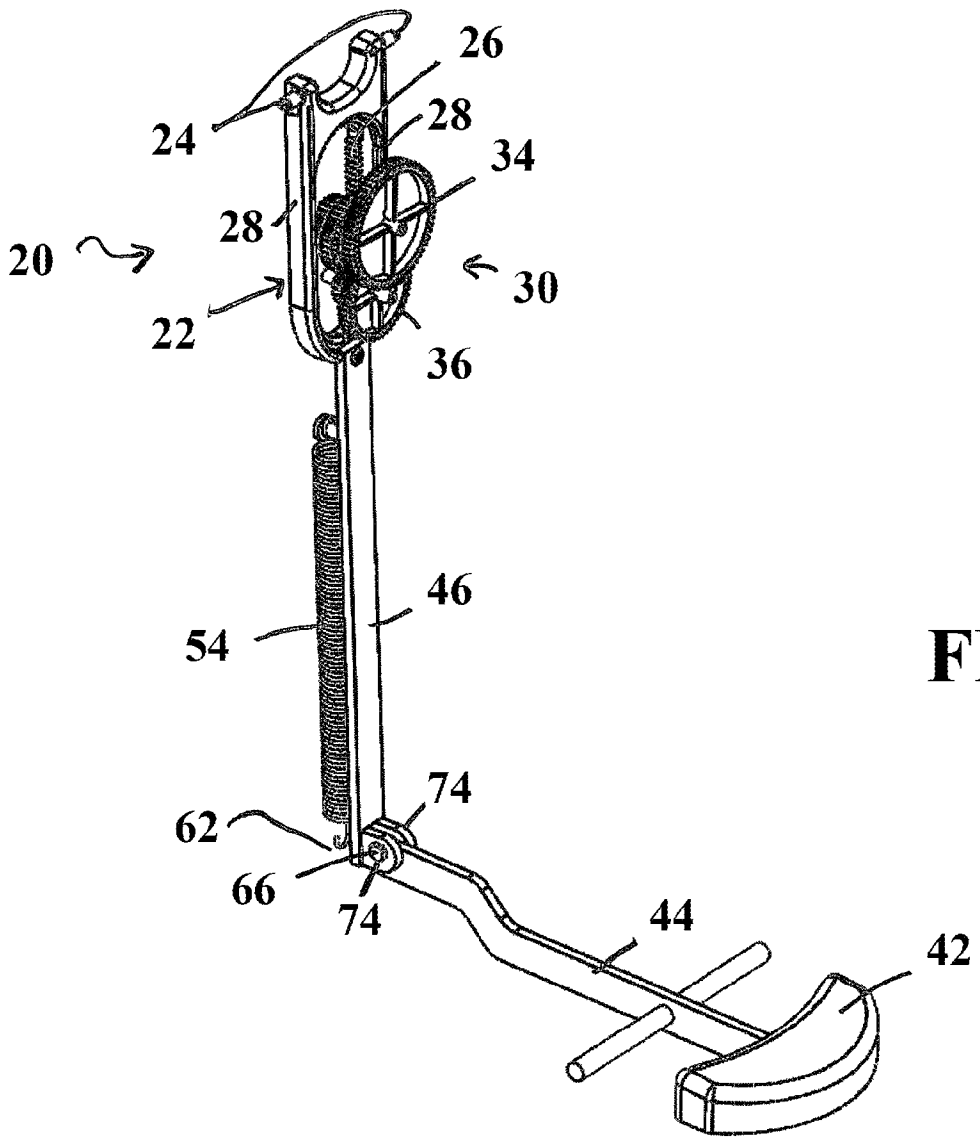
FIG. 12 is another perspective view of the inner mechanical components of the embodiment of the waste disposal device shown in FIG. 8.

In order to provide for rotation of the twisting member relative to the stationary waste-containing member and thus the formation of a twist in the waste-containing member in the slot(s) between the fingers of the membrane (and which is engaged by the fingers), a mechanism for preventing rotation of the waste-containing member is preferably provided. The anti-rotation mechanism or rotation preventing mechanism may be any of those constructions known in the prior art. For example, if the waste-containing member is tubing housed in a cartridge, then the cartridge could be provided with a plurality of indentations, e.g., four, six, eight, that receive projections on the housing of the container 12. On the other hand, the waste-containing member may be a bag such as disclosed in U.S. patent application Ser. No. 12/172,758 filed Jul. 14, 2008, see FIGS. 11-13 thereof.

The waste disposal device 10 also includes a foot pedal assembly 40 which causes both opening of the lid 14 when a foot pedal of the foot pedal assembly 40 is depressed and closure of the lid 14 when the pressing force is removed. The foot pedal assembly 40 may be considered part of the rotation mechanism 18 or not.

Figure 3:
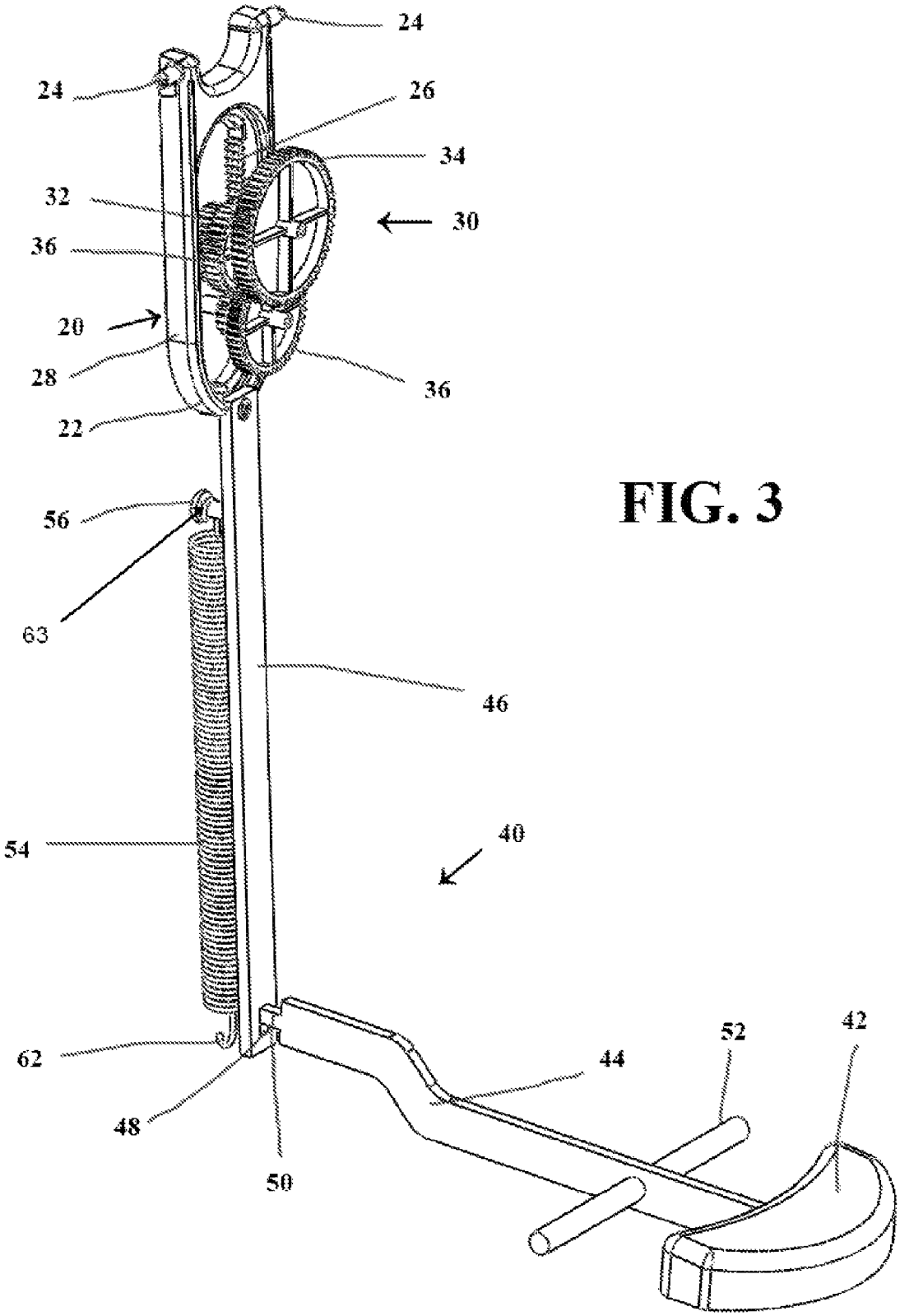
Figure 4:
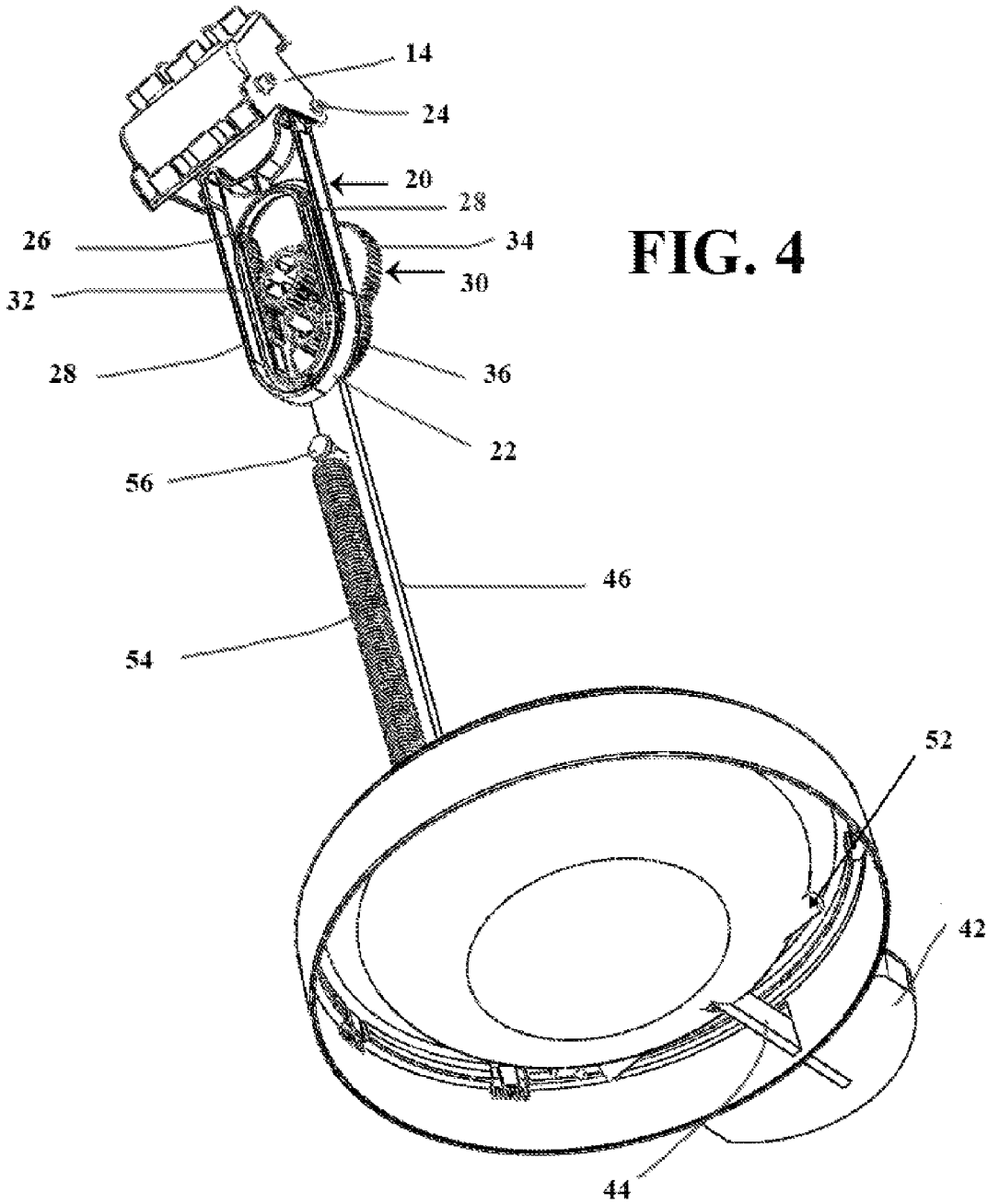
FIG. 4 is a bottom perspective view of principal parts of the lid movement mechanism in the waste disposal device shown in FIG. 1.

The foot pedal assembly 40 includes the foot pedal 42 which extends outward from a lower region of the container 12, a horizontal actuating member 44 connected to the foot pedal 42 at a first end region, a rigid vertical actuating member 46 having a slot 48 through which a projection 50 at the second end region of the horizontal actuating member 44 passes and a pivot pin 52 connected to the horizontal actuating member 44 between its ends (see FIGS. 3 and 4). An upper end region of the vertical actuating member 46 is connected to the U-shaped frame 22, or formed integral therewith (see FIG. 3). The pivot pin 52 is retained as its ends extend through apertures in a base of the container 12 (see FIG. 4).

Figure 5:
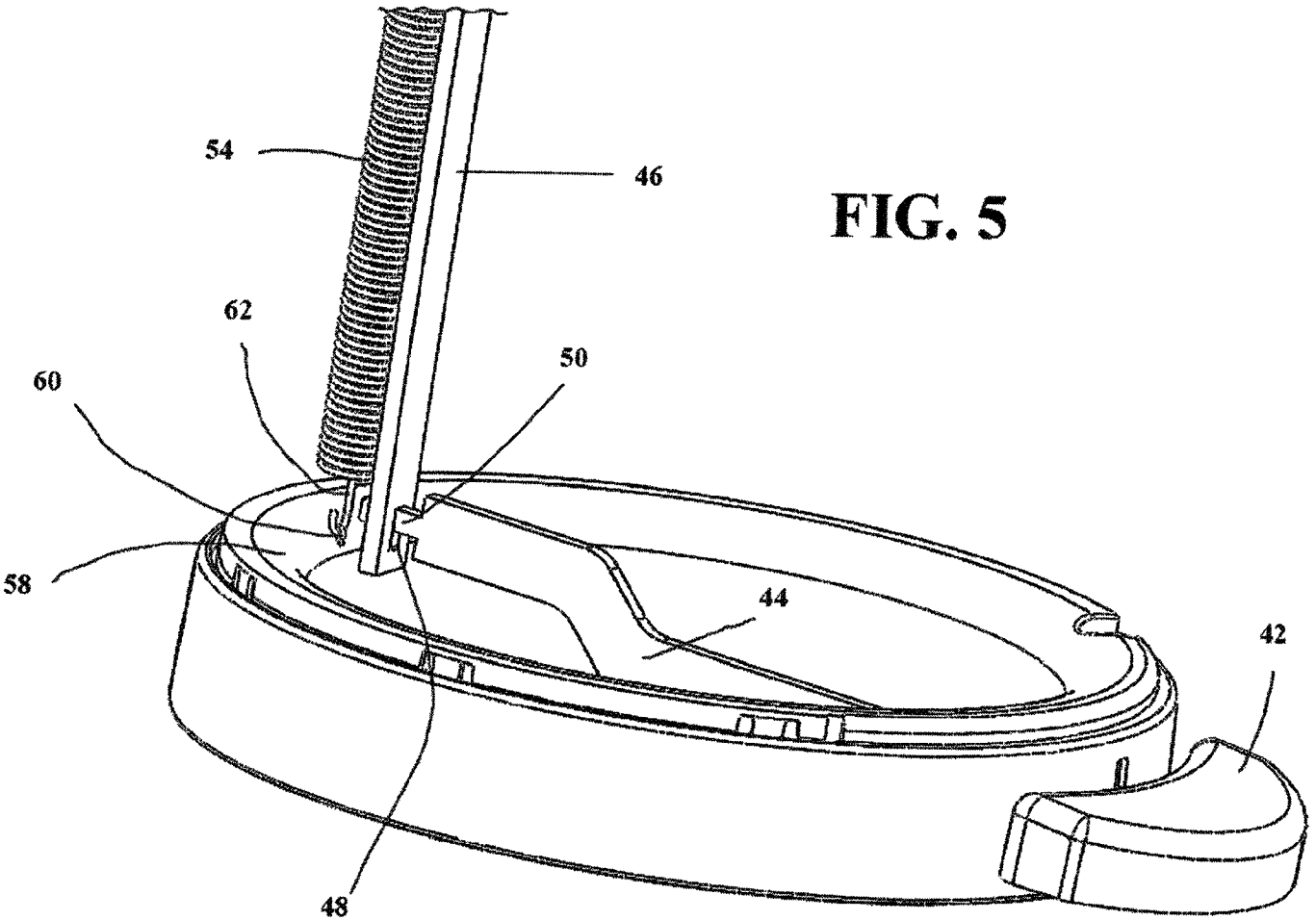
FIG. 5 is an enlarged view of a base region of the waste disposal device shown in FIG. 1 with parts removed to show the lid movement mechanism.

The foot pedal assembly 40 also includes a spring 54 that extends alongside the vertical actuating member 46 and is connected at its upper end to a projection 56 extending from the vertical actuating member 46 (see FIGS. 2-5) and at its lower end region to a loop 60 extending from a base portion 58 of the container 12 (see FIG. 5). The spring 54 may include a hook 63 at its upper end which is hooked onto or over the projection 56. The spring 54 may additionally or alternatively include a hook 62 at its lower end (see FIG. 3) which is hooked onto or through the loop 60 (see FIG. 5). Instead of projection 56 and loop 60, apertures may be formed, i.e., in a portion of the vertical actuating member 46 and the base portion 58, in which the hooks of the spring 54 could be retained.

The spring 54 is designed to replace the manual force applied by the user to engage the gear assembly 30. In effect, the spring 54 stores force during the opening of the lid 14 by user depression of the foot pedal 42 and this stored force is applied to close the lid 14 and cause the rotational movement of the twisting member of the twisting mechanism 16.

With this structure, depression of the foot pedal 42 causes pivoting of the horizontal actuating member 44 about the pivot pin 52, i.e., the first end of the horizontal actuating member 44 proximate the foot pedal 42 pivots downward while the second end of the horizontal actuating member 44 proximate the vertical actuating member 46 pivots upward. This upward pivotal movement causes the projection 50 to abut against the upper interior surface defining the slot 48 and urge the vertical actuating member 46 upward. At the same time, the spring 54 is tensioned in view of the fixing of its lower end to the base portion 58 and the fixing of its upper end to the projection 56 on the vertical actuating member 46. The upward movement of the vertical actuating member 46 causes the U-shaped frame 20 to move upward thereby forcing the lid 14 to open. In view of the presence of the optional mechanism to enable one-way transmission of rotational force from the rack gear 26 to the drive gear 34, the drive gear 34 is not rotated during the opening movement of the lid 14.

As long as the foot pedal 42 is depressed, i.e., by the user's foot, the lid 14 will remain open. However, once the force depressing the foot pedal 42 is removed, the spring 54 will naturally compress and urge the vertical actuating member 46 downward, in turn causing the U-shaped frame 22 to be urged downward thereby causing the rack gear 26 to move downward. As described above, the downward movement of the rack gear 26 is converted into rotation of the drive gear 34 and thus rotation of the twisting member of the twisting mechanism 16. At the same time, the first end of the horizontal actuating member 44 proximate the foot pedal 42 will also be pivoted upward into a position in which it can be depressed again.

Thus, the foot pedal assembly 40 enables use of the waste disposal device 10, both opening of the lid 14 and closing of the lid 14, solely by use of the user's foot (in a hands-free manner). Therefore, there is no manual contact between the user's hands and any portion of the waste disposal device 10 which is required in order to open the lid 14 or close the lid 14. This eliminates any problems resulting from the user holding other materials and being unable to close the lid as well as problems resulting from contact between the user's hands and bacteria or other harmful microorganisms on the lid.

Waste disposal device 10 may be used for any type of waste, including but not limited to medical waste from hospitals, doctors' offices, home health care personnel and facilities, nursing homes, biohazard laboratories, and the like. The waste disposal device 10 may also be used for personal hygiene such as for disposing of soiled diapers.

Modifications to the waste disposal device 10 are envisioned. For example, an access door may be formed in the outer wall of the container 12 to pivot about hinges to enable access to an interior waste-receiving chamber of the container 12 in which a pail may be placed to receive a bag which will be filled with waste during use of the waste disposal device 10. A closure mechanism would be provided to secure the door in a closed position.

Figure 6:
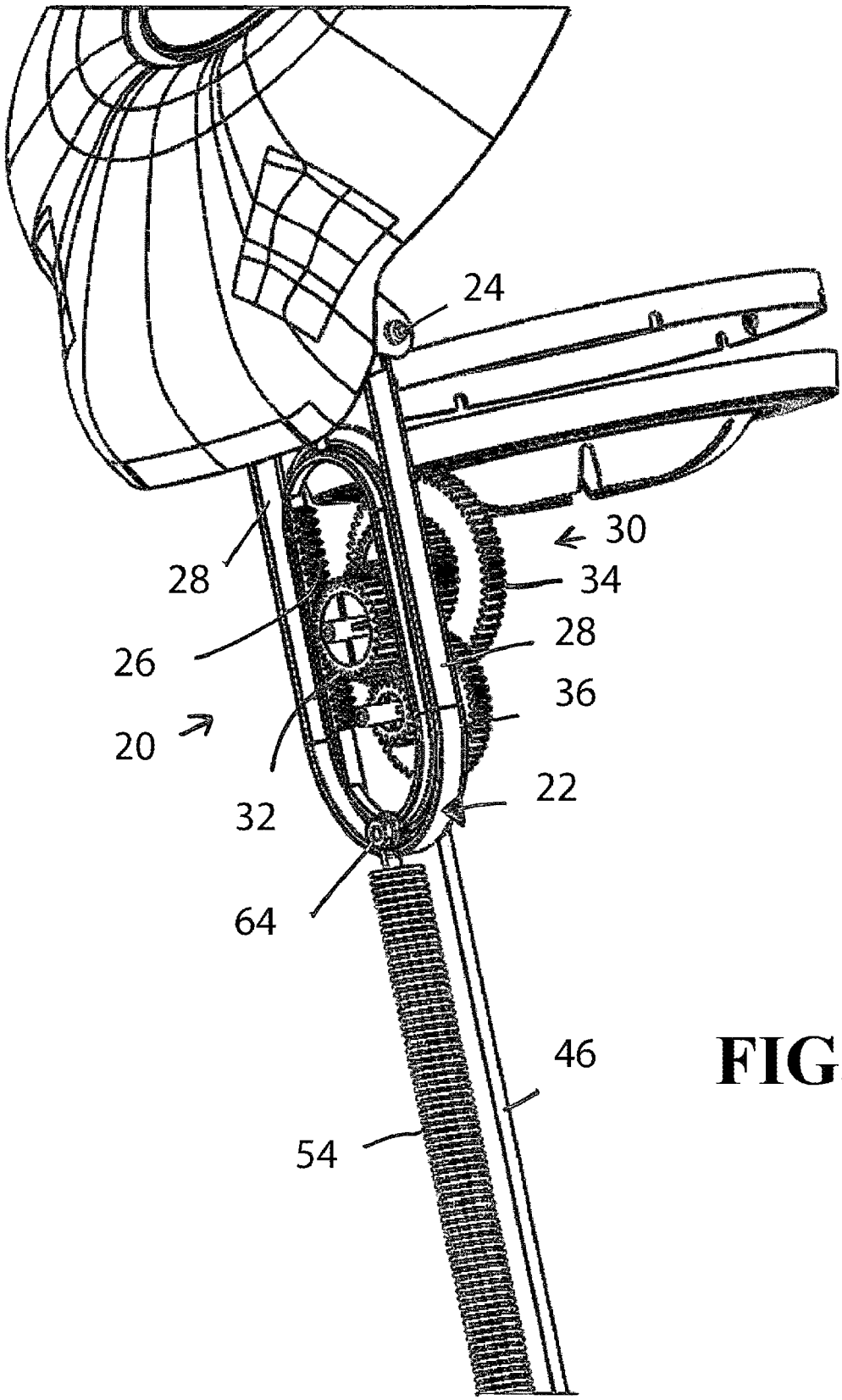
FIG. 6 is a perspective view of the inner mechanical components of another embodiment of a waste disposal device wherein a spring is connected to a U-shaped rack gear assembly.
Figure 7:
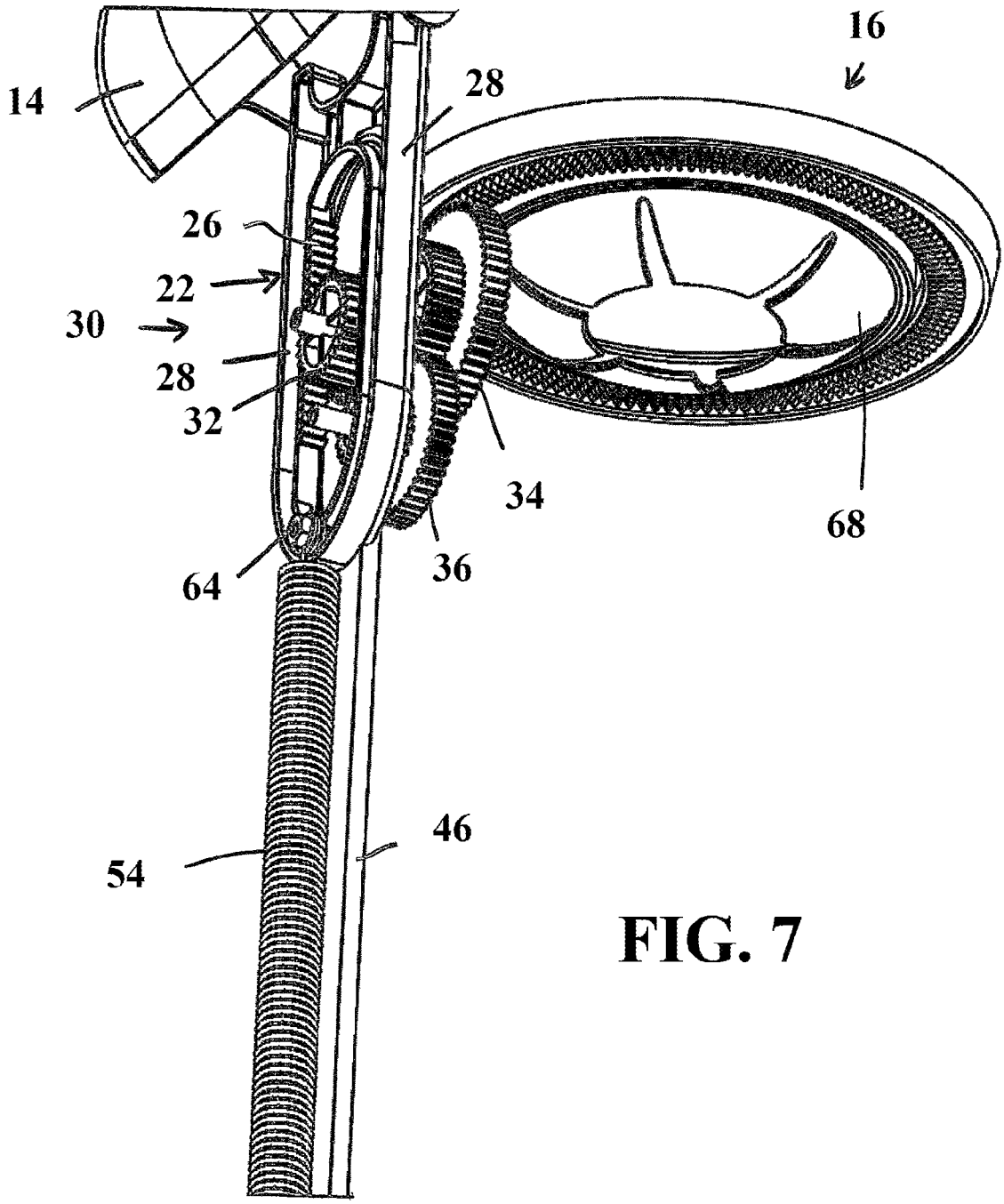
FIG. 7 is a perspective view of the inner mechanical components of the embodiment of the waste disposal device shown in FIG. 6 also showing a membrane.
Figure 8:
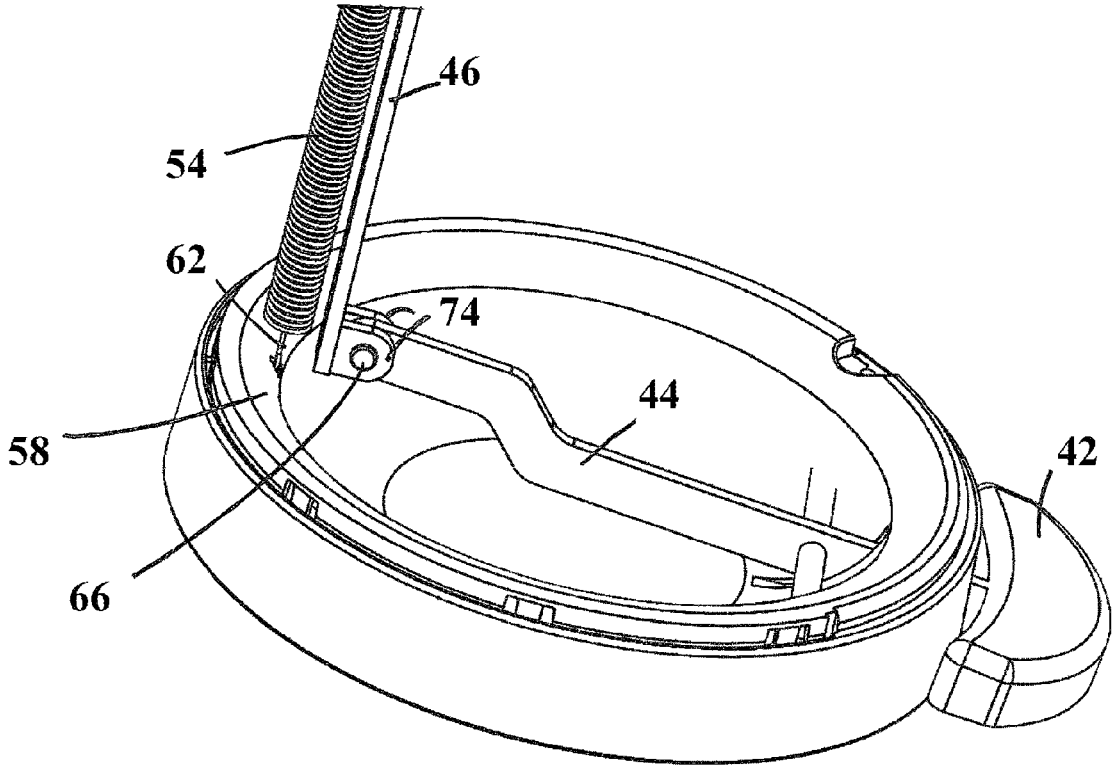
FIG. 8 is an enlarged view of a base region of another embodiment of a waste disposal device in accordance with the invention with parts removed to show the lid movement mechanism.

Referring now to FIGS. 6 and 7, in this embodiment, the spring 54 is directly attached to the U-shaped rack gear assembly 20, and more specifically to the U-shaped frame 22 thereof. The manner in which the upper end region of the spring 54 is attached to the rack gear assembly 20 may vary and in the illustrated embodiment, a nut 64 is used (see FIGS. 6 and 7). Alternatively, the spring 54 may be hooked to a projection or protrusion on the rack gear assembly 20. The bottom of the spring 54 is mounted to the base portion 58 in the same method as described above with respect to FIG. 5 and described above.

FIG. 7 also shows that the twisting mechanism 16 includes a grasping member such as a membrane 68 arranged to engage with waste-containing member.

Referring now to FIGS. 8-13, in this embodiment, the vertical actuating member 46 is attached to the horizontal actuating member 44 via a pivotable connection, e.g., a pivot pin 66 that extends through mounting projections 74 arranged at a lower region of the vertical actuating member 46 (see FIGS. 8-12). The presence of a slot in the lower region of the vertical actuating member 46 as shown in FIGS. 3 and 5 is not required for this embodiment. As such, the horizontal actuating member 44 may be a bar or a rigid rod.

Mounting projections 74 may be welded or otherwise attached to the vertical actuating member 46 or formed integral therewith. Mounting projections 74 provide a pivot point when attaching the horizontal actuating member 44 to the vertical actuating member 46, e.g., via a pivot pin 66 that passes through an aperture 116 in the front end region of the horizontal actuating member 44 (see FIG. 10).

Figure 9:
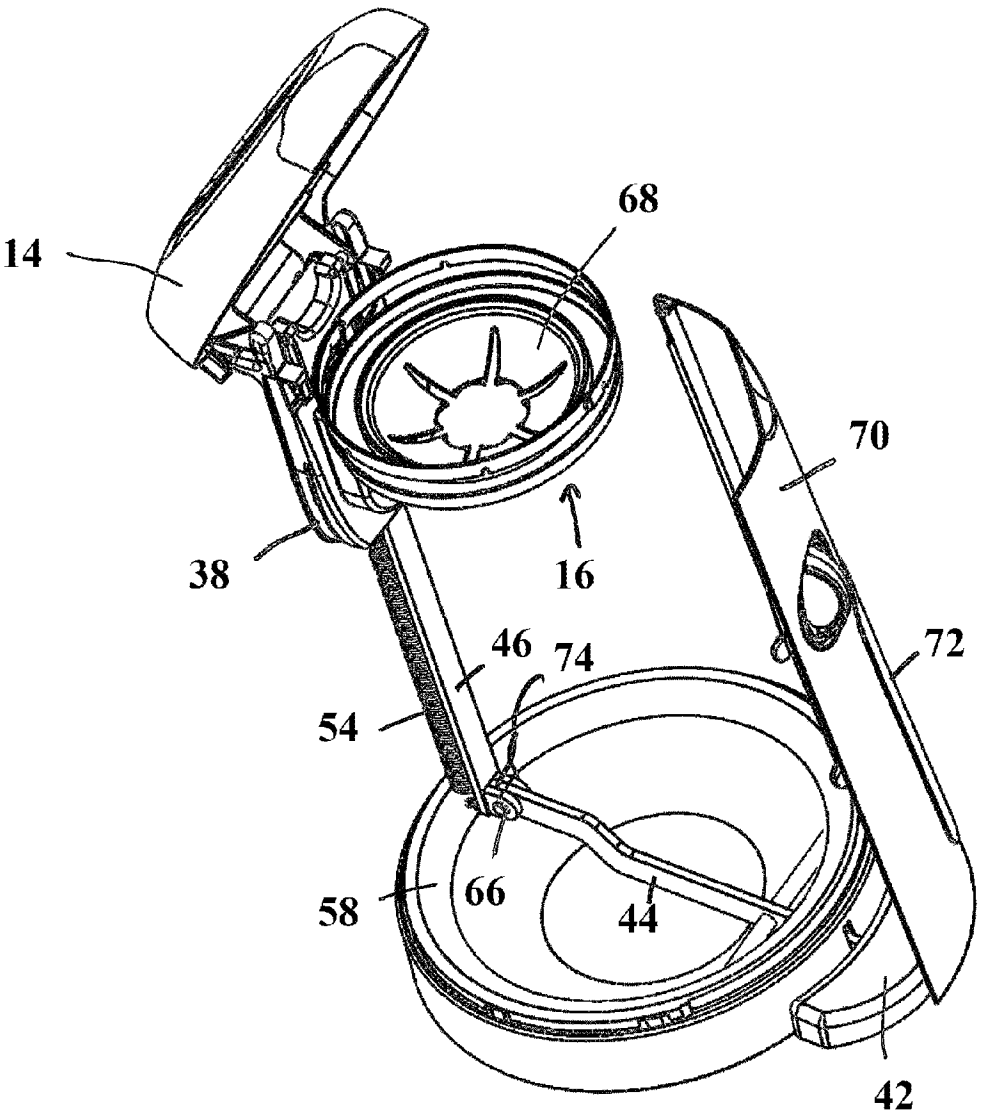
FIG. 9 is a perspective view of the inner mechanical components of the embodiment of the waste disposal device shown in FIG. 8 also showing a front access door.
Figure 10:
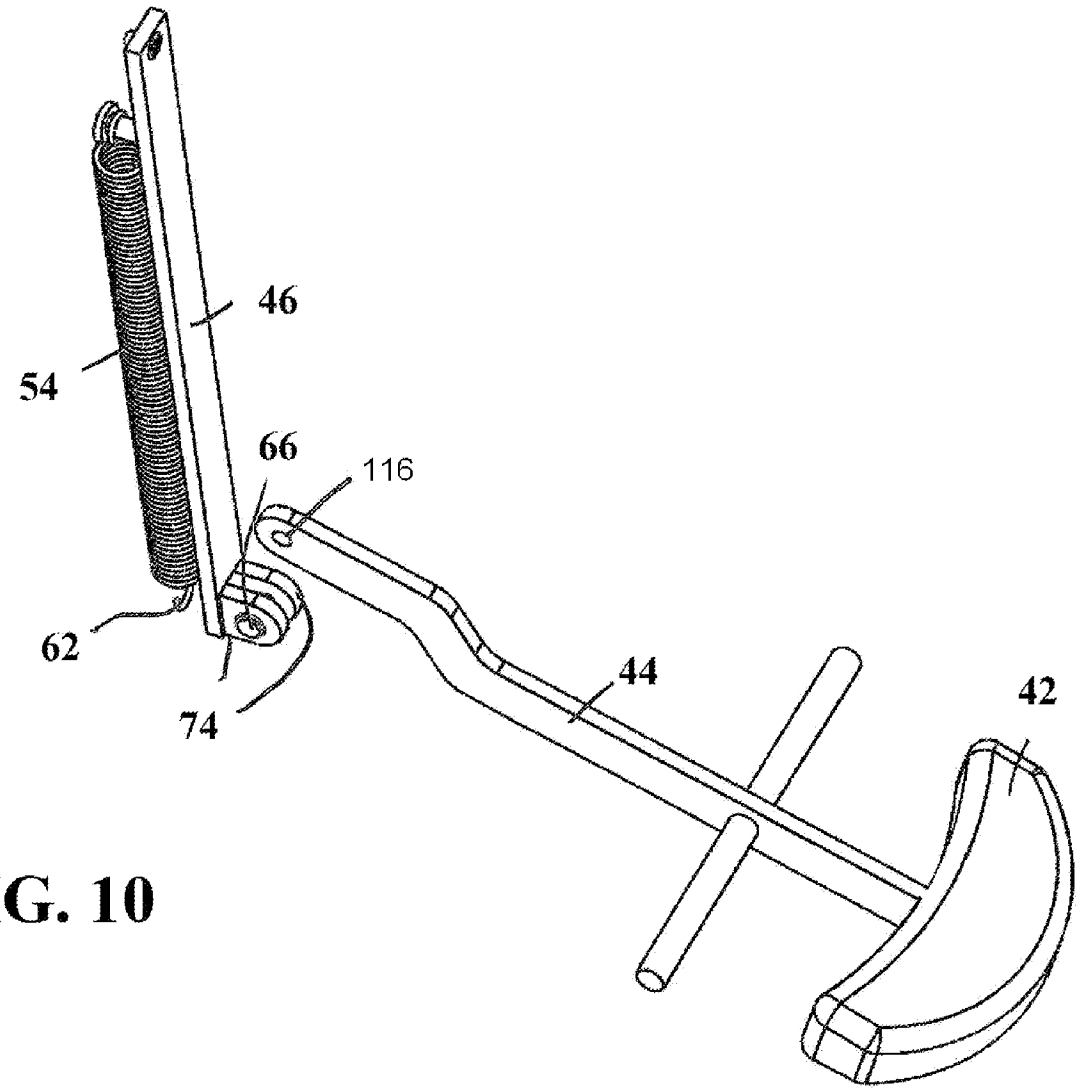
FIG. 10 is another perspective view of the inner mechanical components of the embodiment of the waste disposal device shown in FIG. 8.
Figure 13:
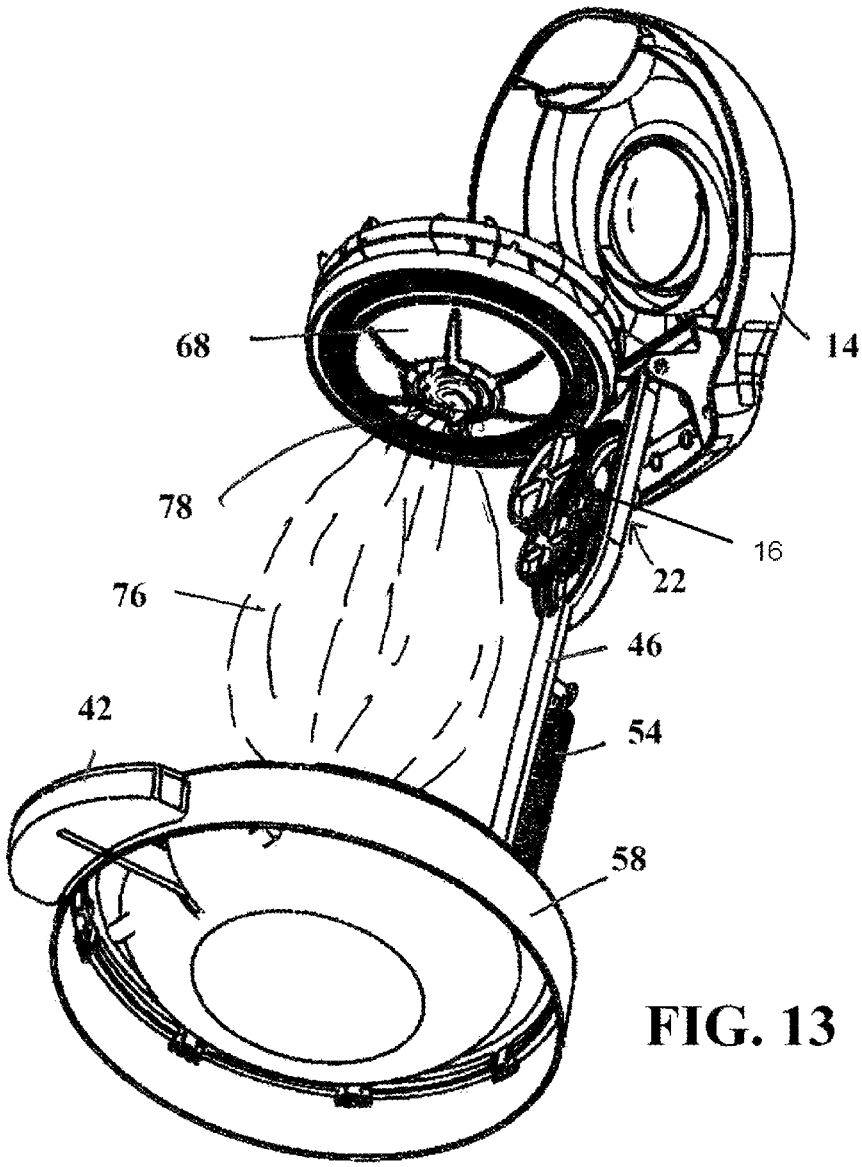
FIG. 13 is a perspective view of the embodiment of the waste disposal device shown in FIG. 8 including a bag or tubing shown without its surrounding container.
Figure 14:
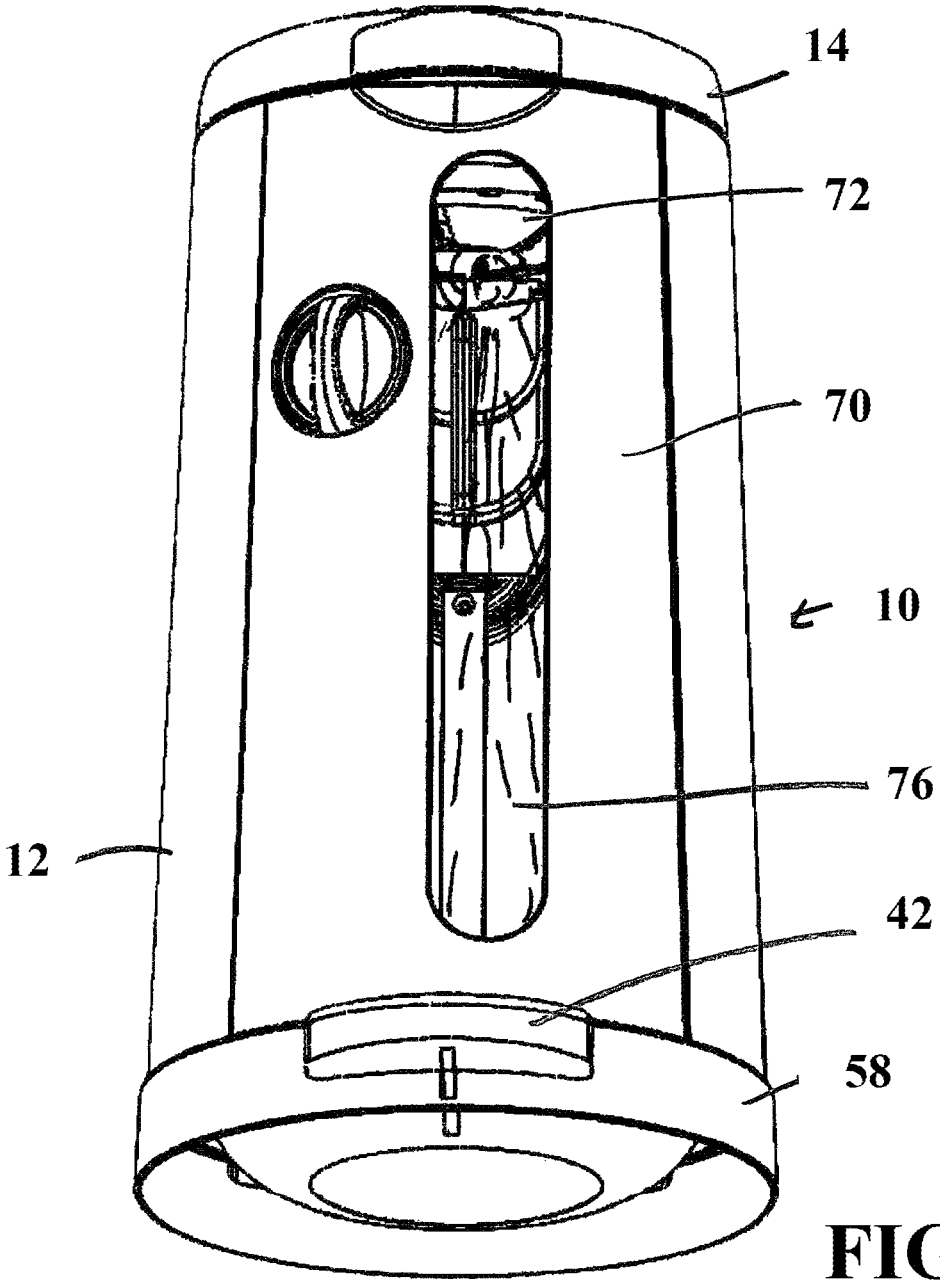
FIG. 14 is a perspective view of yet another embodiment of a waste disposal device in accordance with the invention including a window.

FIGS. 9 and 13 also show that the twisting mechanism 16 also includes a grasping member such as a membrane 68 arranged to engage with waste-containing member. FIG. 9 further shows a door 70 for the container 12 and which includes an optional transparent or see-through window 72 (discussed more fully below with reference to FIGS. 14-17).

The shape of the window 72 may be varied from that shown, i.e., differ from the vertically oriented elongate shape with curved upper and lower ends. A main purpose of the access door 70 with a window 72 is to enable a user of the waste disposal device 10 to view the status of a bag or tubing (76, see FIG. 13) as well as the status of any twist 78 in the substrate of the bag or tubing 76 through the window 72. Thus, the user can view the bag or tubing 76 before opening the access door 70 to ascertain whether the bag or tubing 76 is full and if so, then open the access door 70 to remove the bag or tubing 76. Or the user can ascertain whether a twist 78 is present when the lid 14 is in a closed state to ensure that the waste disposal device 10 is operating properly.

Referring now to FIGS. 14-17, this embodiment of a waste disposal device exemplifies the possibility of providing a window 72 on the front door 70, as additionally shown in FIGS. 1 and 9. Window 72 may be applied in any of the embodiments disclosed herein. Window 72 may also be formed on the body of the container 12, apart from the door 70. While placement of the window 72 on the door 70 is practical from a manufacturing standpoint, the window 72 can be, for example, left or right of the door 70, or for that matter on both sides. Also, if desired, more than one window 72 may be provided, e.g., one on the door 70 and one next to the door 70.

Figure 15:
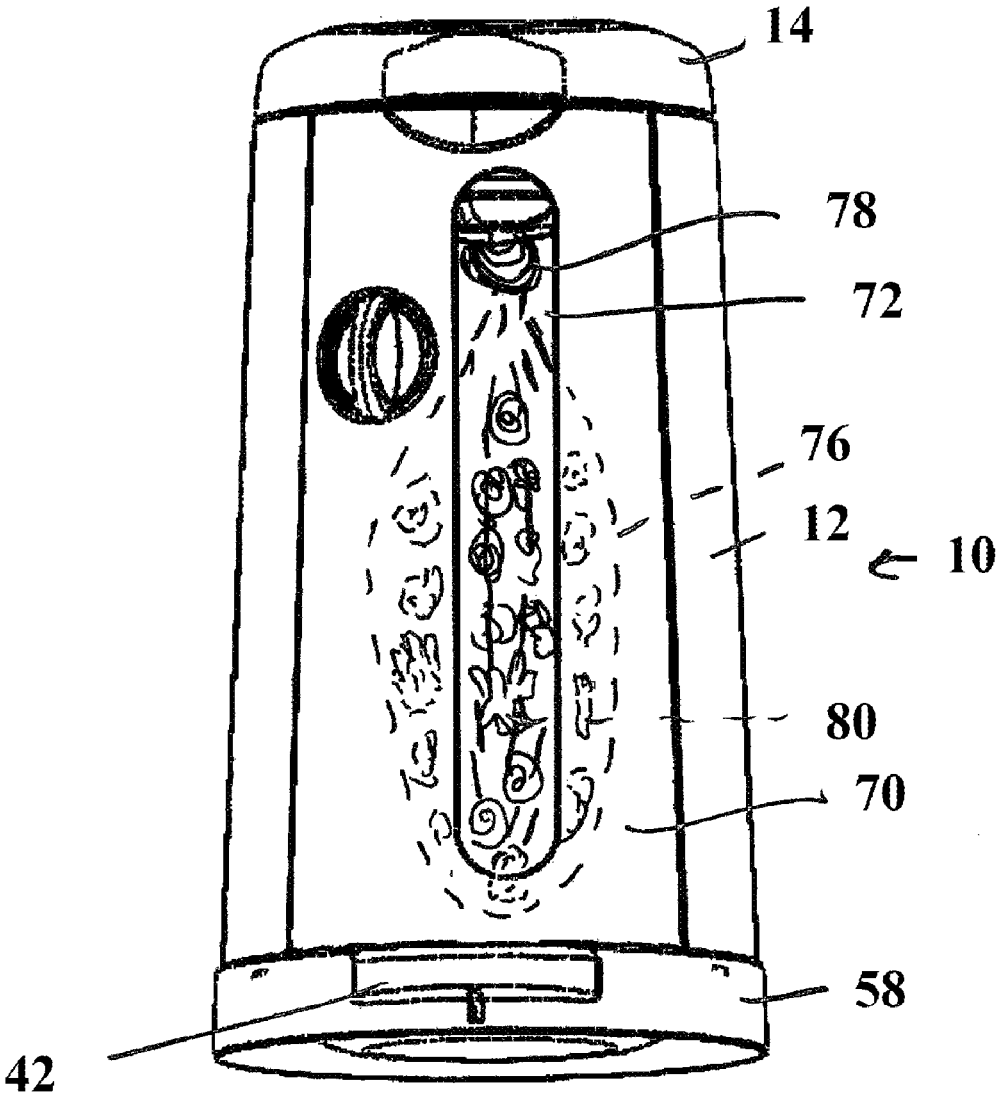
FIG. 15 is a perspective view of the embodiment of the waste disposal device shown in FIG. 14 showing a bag or tubing with waste therein.
Figure 16:
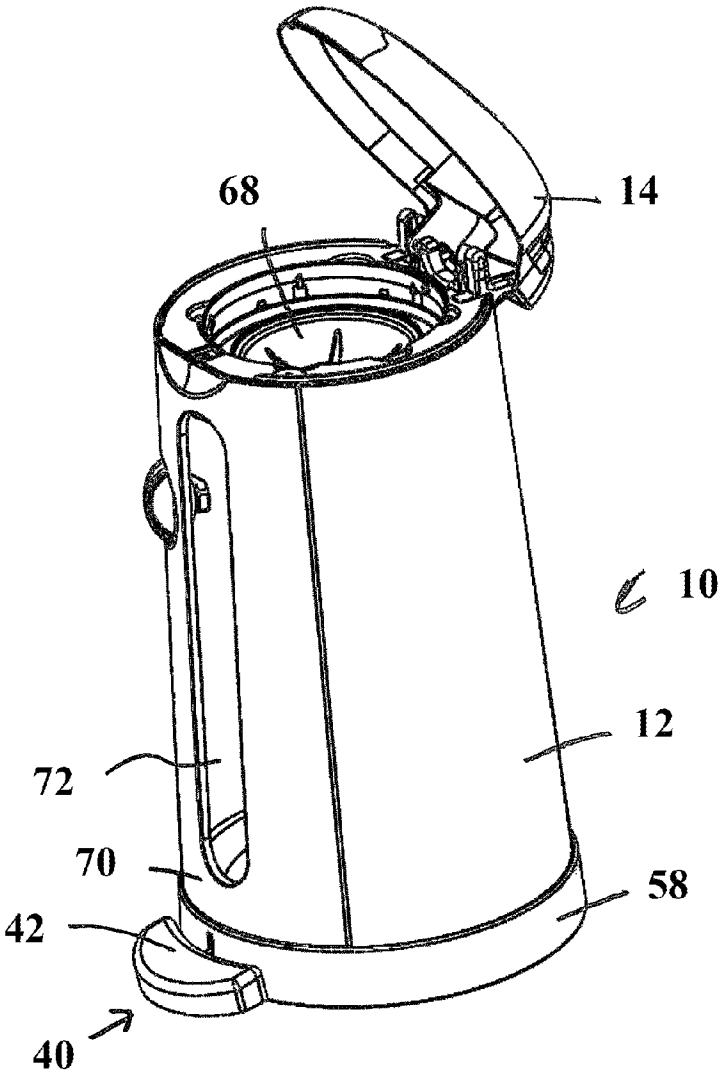
FIG. 16 is a perspective view of the embodiment of the waste disposal device shown in FIG. 14 with lid open.
Figure 17:
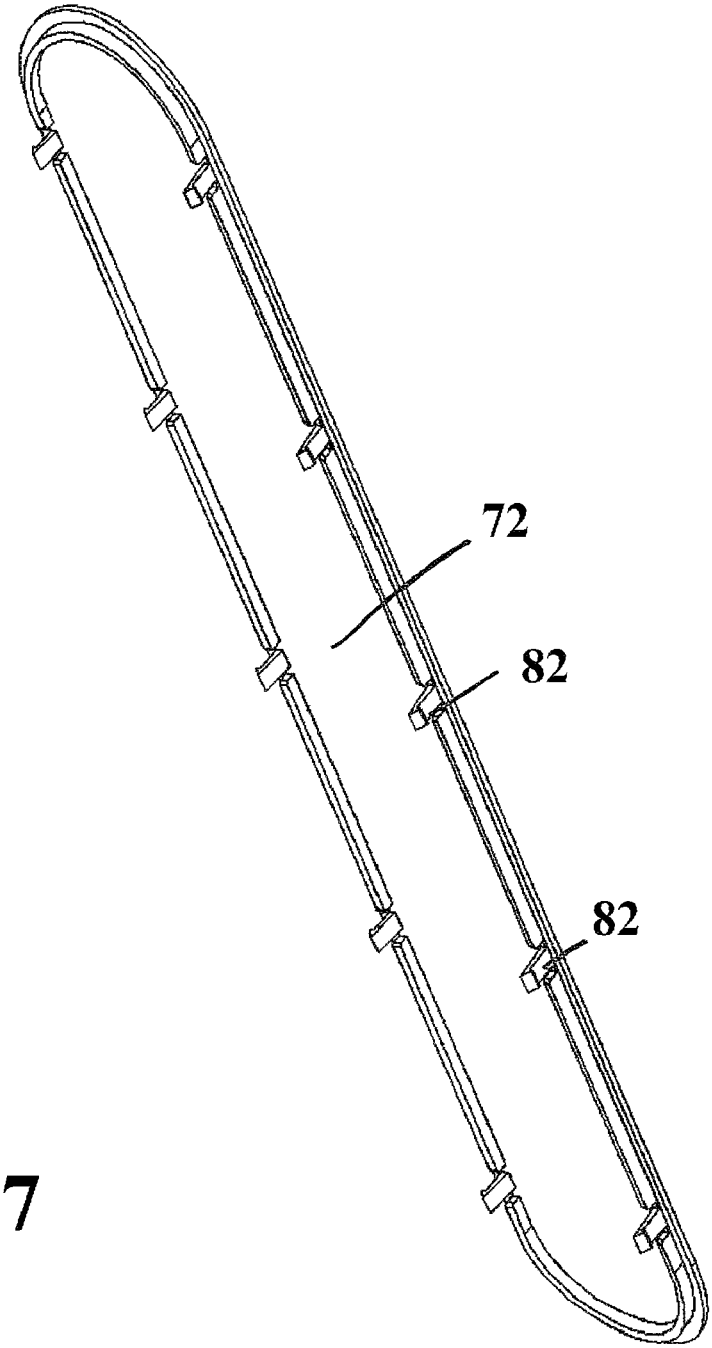
FIG. 17 is a perspective view of the window in the waste disposal device shown in FIG. 14.

An important purpose of the elongated window 72 is to be able to view the bag or tubing 76 being filled with waste 80 in the waste disposal device 10 without having to open the door 70 (see FIG. 15). As such, a user can view into the interior of the waste disposal device 10 to ascertain the status of the waste 80 in the bag or tubing 76 (see FIG. 15), without opening the door 70. Window 72 therefore provides a means by which the user can limit the number of times the door 70 is opened to see if the container 12 is full before the user needs to remove the waste 80 in the bag or tubing 76 for disposal. This clear window 72 (in the forms of a lens, glass, etc.) improves safety by reducing smell and bacteria because the user does not have to open the door 70 until they are absolutely ready to remove the waste.

Providing window 72 yields tremendous advantages over conventional waste disposal devices that lack a transparent window. With such conventional waste disposal devices, the user may not know when the bag is full. Moreover, a window is not necessary for those conventional waste disposal devices that include an opaque liner that would block the view of the bag of waste, The window 72 is attached to the front door 70 by projections 82 (see FIG. 17). Other means for attaching the window 72 to the door 70 are also envisioned.

Although shown with an oval shape, window 72 may have other shapes and sizes because the shape and size is not a limiting factor. Ideally, the window should enable visualization of the extent of fullness of the bag or tubing 76, and optionally also of the twist 78 therein. In fact, although perhaps less desirable, the door 70 in its entirety may be molded in a transparent plastic substrate. While the door is practical from a manufacturing standpoint, the window can be, for example, left or right of the door, or for that matter on both sides. Or there may be one or more windows, etc. as mentioned above.

Referring now to FIGS. 18-26, these embodiments of a waste disposal device include a spring and rod assembly 90, hereinafter referred to as a spring assembly. Spring assembly 90 includes a bar or rod 92, e.g., a ¼ inch diameter rod, mounted at a lower region to the horizontal actuating member 44 (see FIGS. 19, 22, 24 and 25) and attached at an upper region to rack gear assembly 20, e.g., to a bottom portion of the U-shaped frame 22 thereof (see FIGS. 18-21).

Circumventing or around the rod 92 is a compression spring 94 (se FIGS. 20, 21 and 23-25) that should be large enough in diameter to freely compress and relax over the rod 92. Rod 92 may have a circular cross-section or round profile, and can also have a square or other profiles as long as it fits inside the spring 94 and the spring 94 can compress and relax freely.

Figure 18:
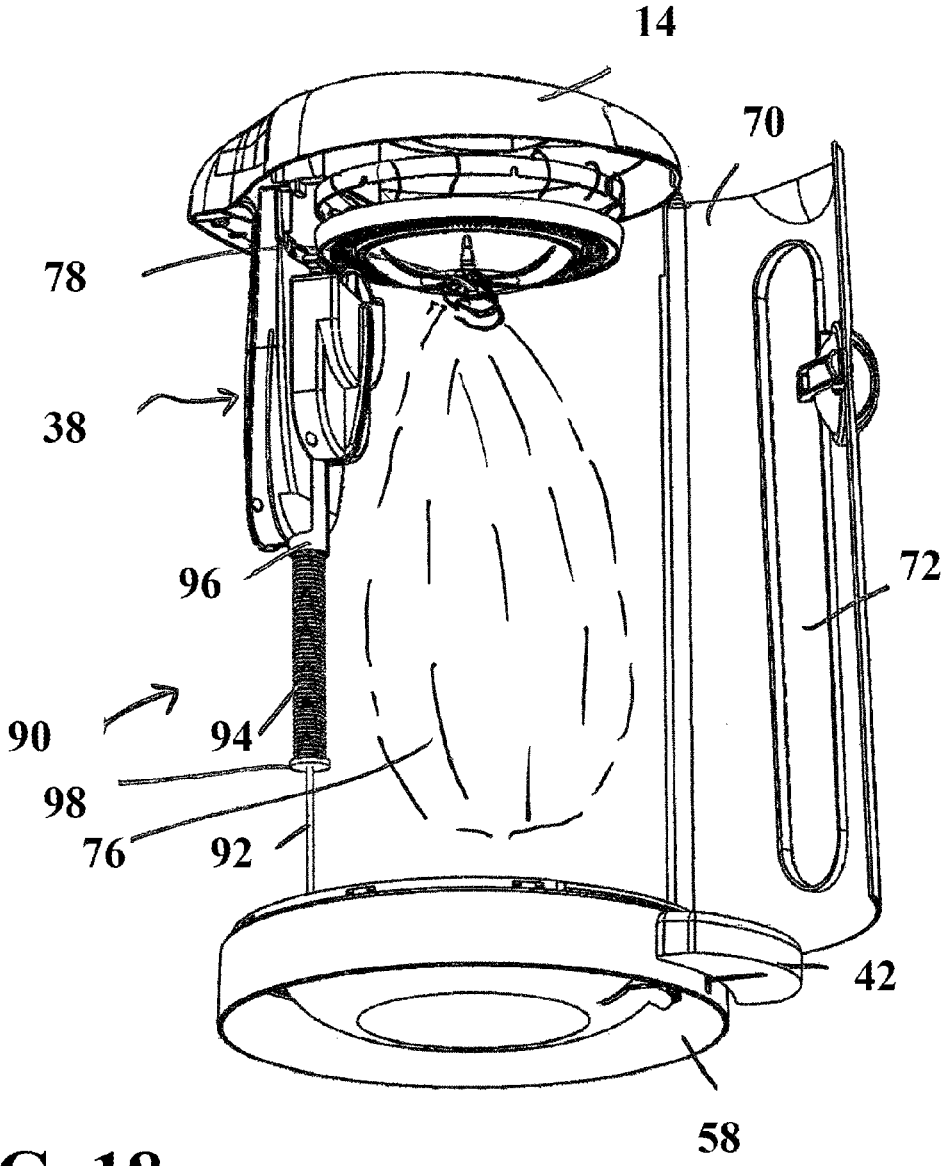
FIG. 18 is a perspective view of still another embodiment of a waste disposal device in accordance with the invention.
Figure 19:
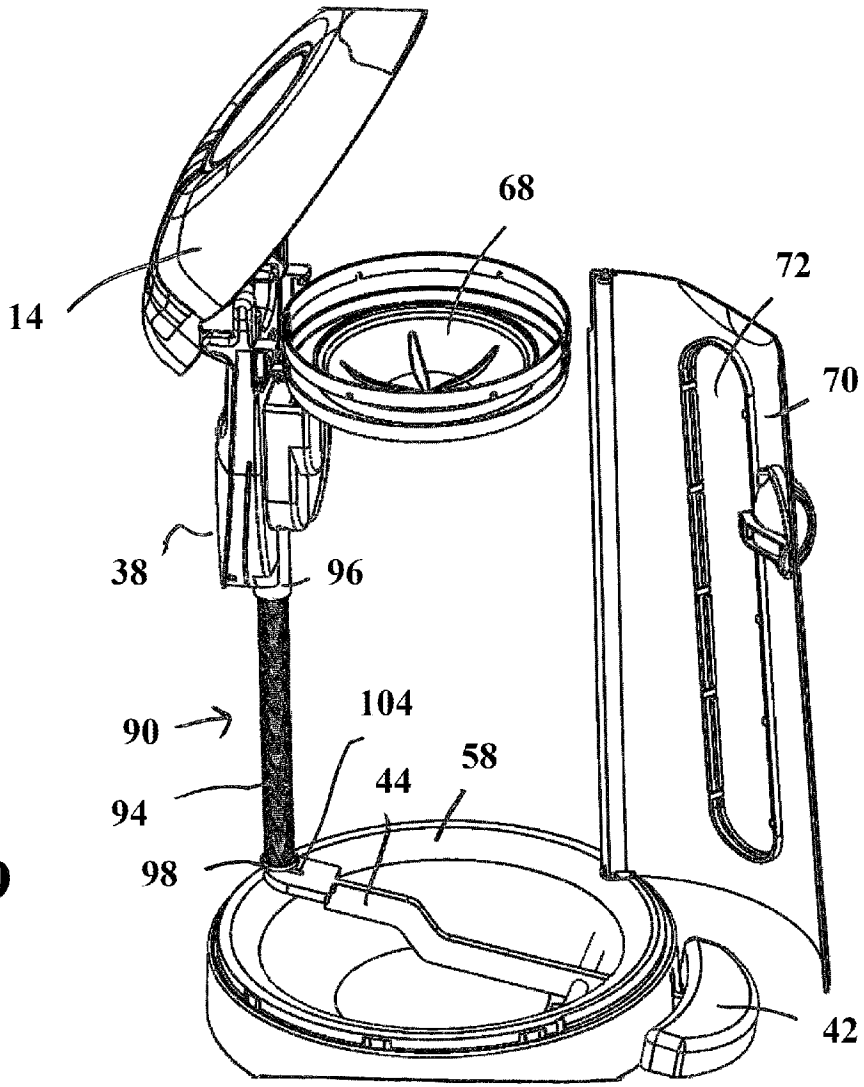
FIG. 19 is a perspective view, with parts cutaway, of the embodiment of the waste disposal device shown in FIG. 18.
Figure 20:
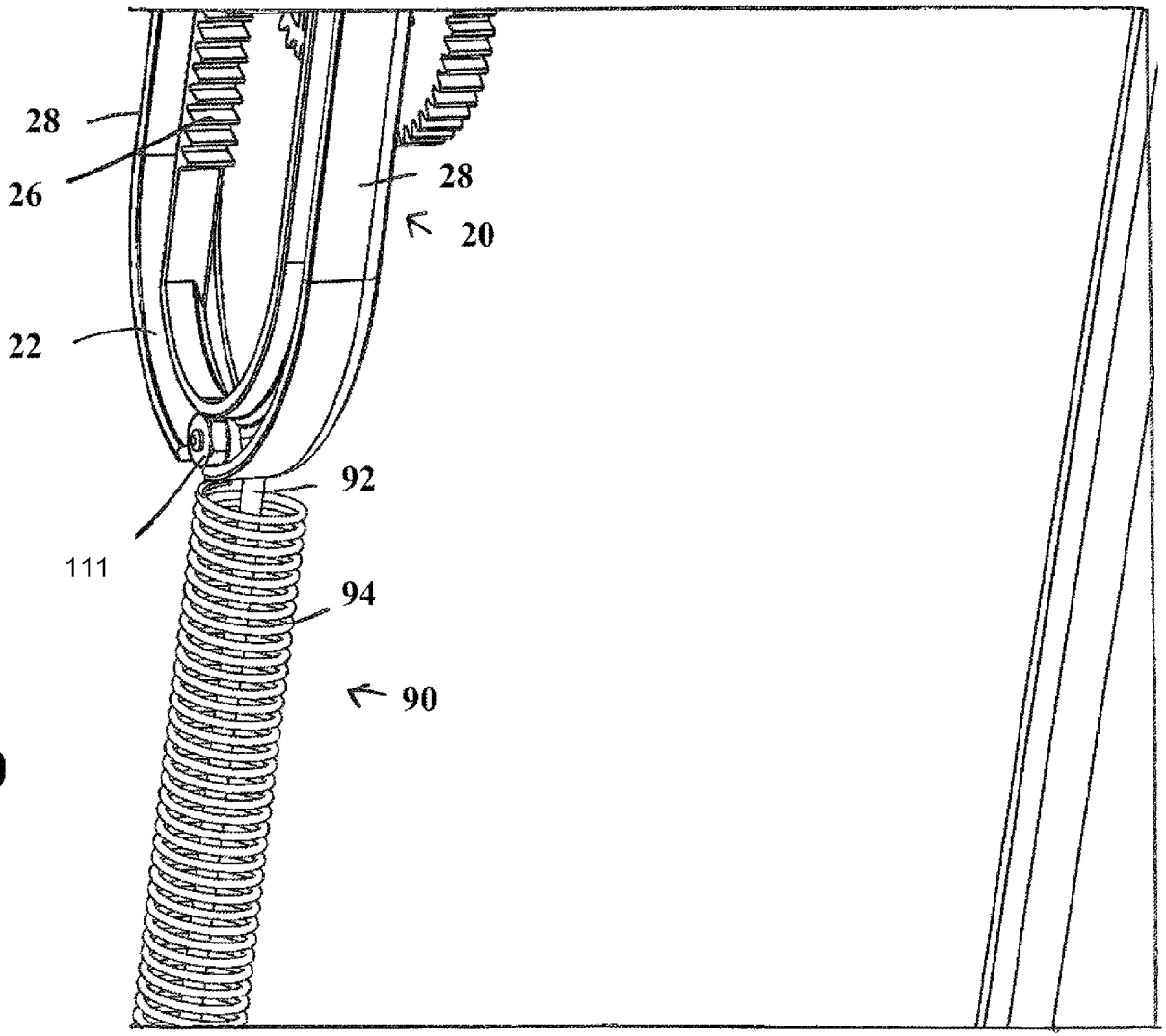
FIG. 20 is an enlarged view of the connection of the spring assembly to the rack gear assembly in the embodiment of the waste disposal device shown in FIG. 18.
Figure 21:
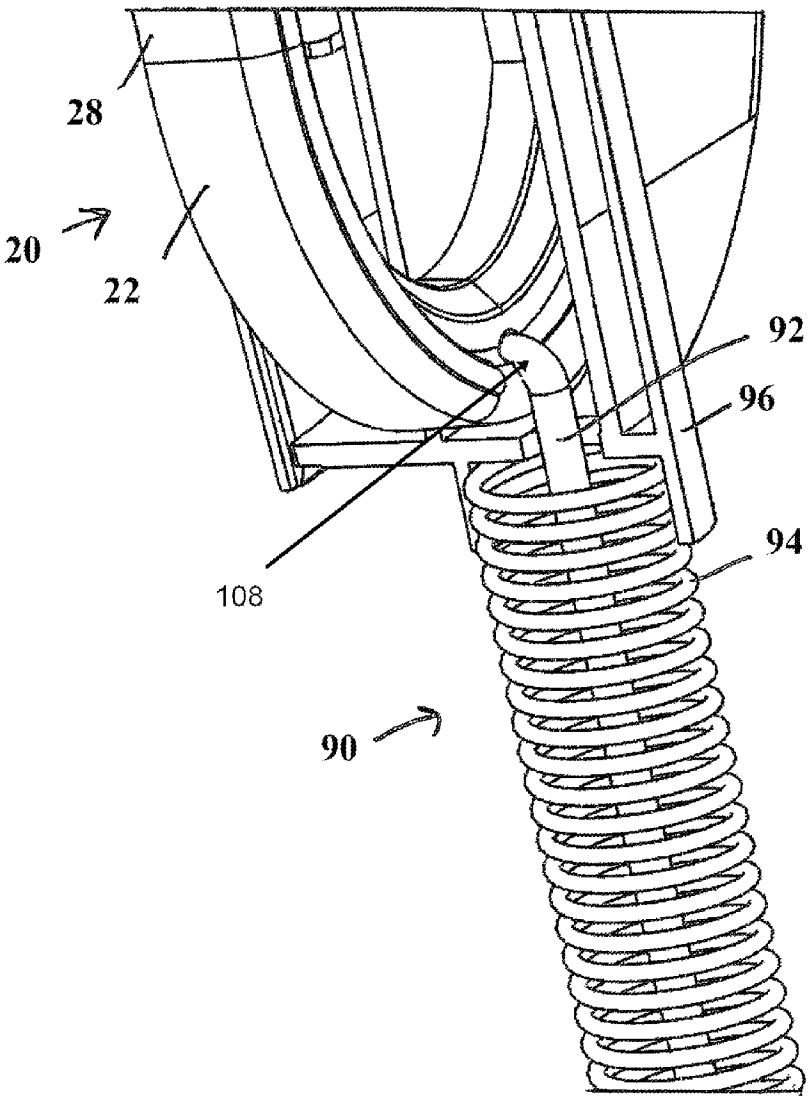
FIG. 21 is another enlarged view of the connection of the spring assembly to the rack gear assembly in the embodiment of the waste disposal device shown in FIG. 18.

The compression spring 94 can be a full length spring extending entirely between the U-shaped frame 22 and the horizontal actuating member 44 (see FIGS. 18 and 19). It can also be a shorter spring that engages the rack gear assembly 20 and a welded place along the rod 92, for example. The compression spring 94 is essentially trapped on the top in the gear housing 38, by a retaining member 96 (see FIGS. 18, 19 and 21), and on the bottom in a cupped recessed area along the rod 92, bar or other profile by means of another retaining member 98 (see FIGS. 19, 23 and 25).

Figure 22:
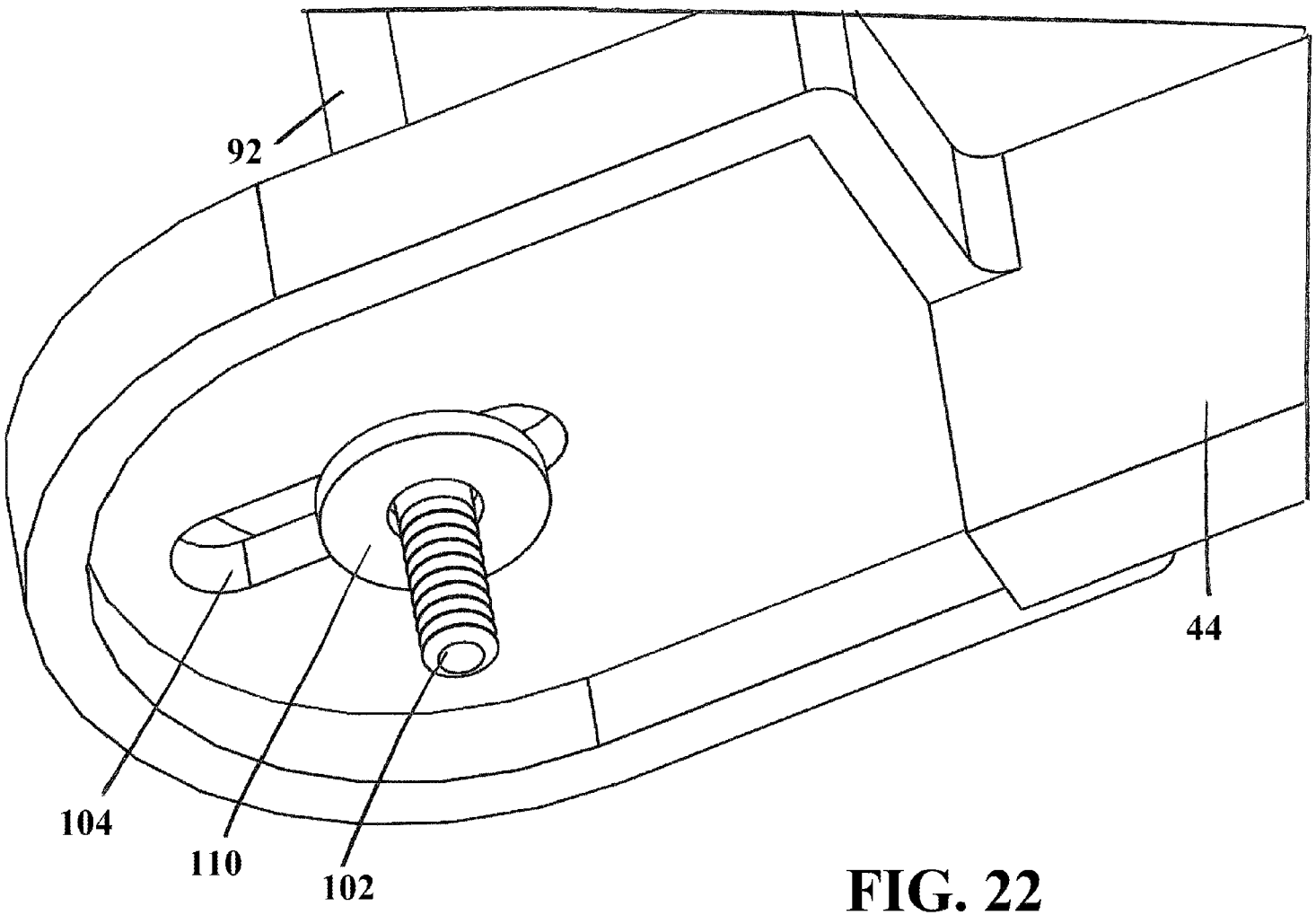
FIG. 22 is an enlarged view of the connection of the spring assembly to the horizontal actuating member in the embodiment of the waste disposal device shown in FIG. 18 shown without a nut.
Figure 23:
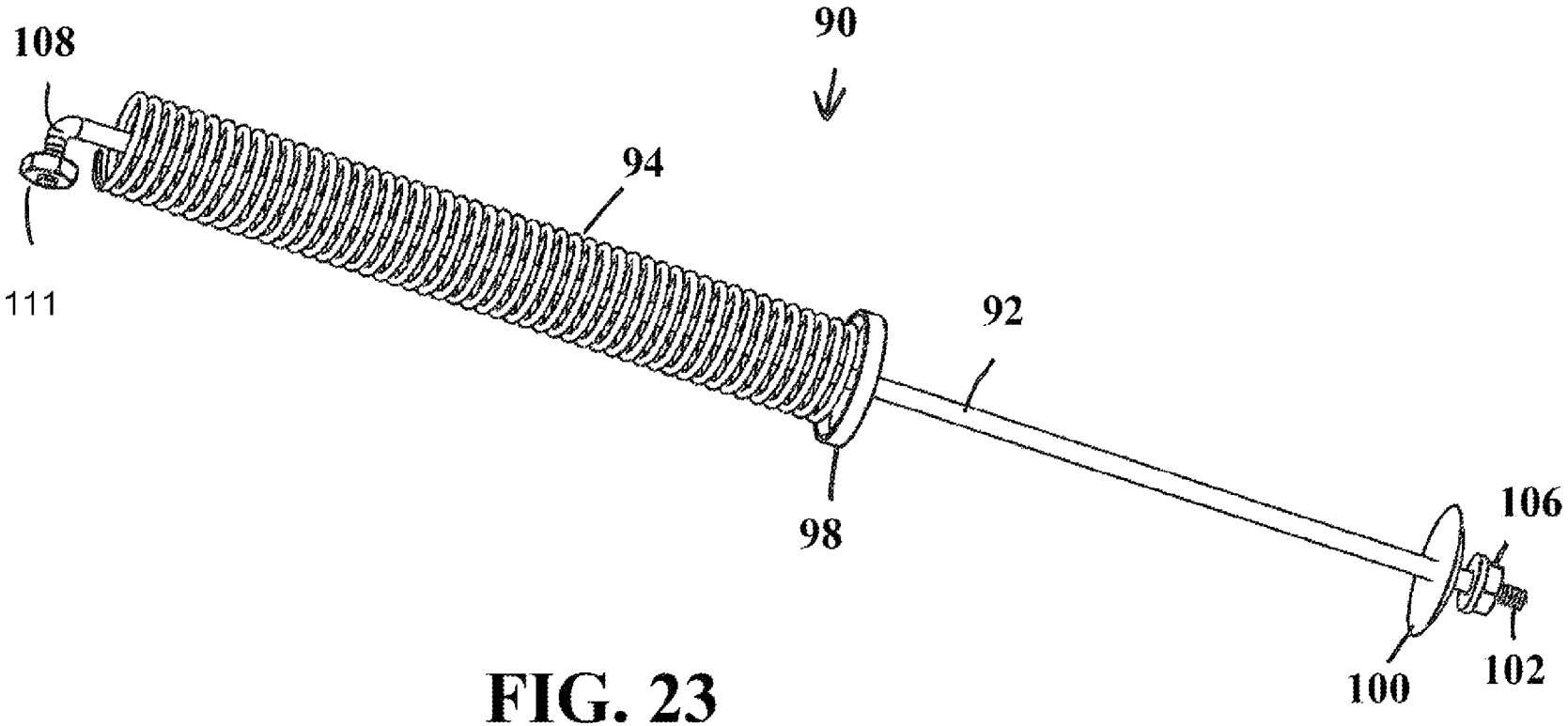
FIG. 23 is a perspective view of the spring assembly of the embodiment of the waste disposal device shown in FIG. 18.
Figure 24:
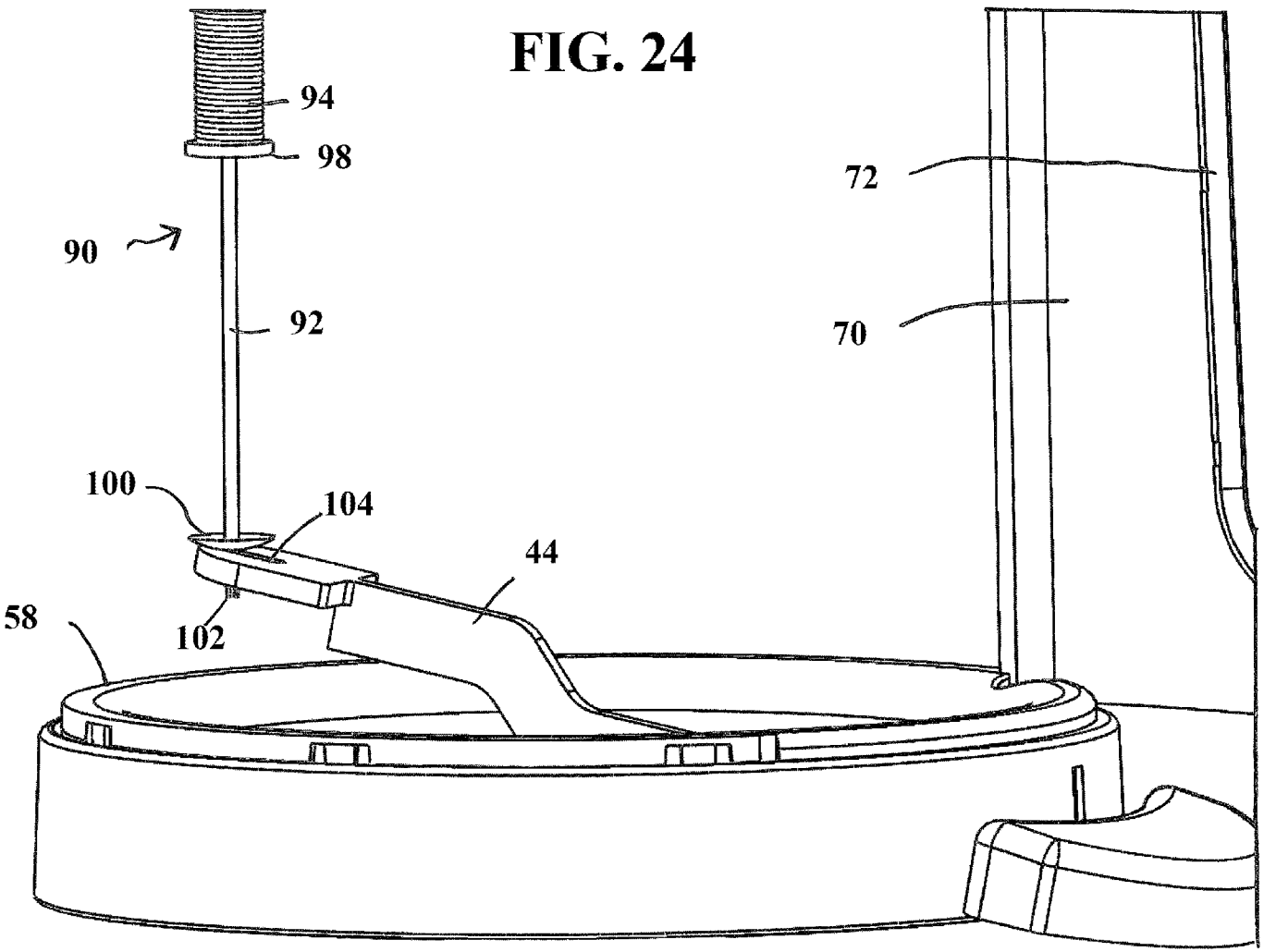
FIG. 24 is a perspective view of the lower portion of the embodiment of the waste disposal device shown in FIG. 18 with the spring in a position in which the lid is open.
Figure 25:
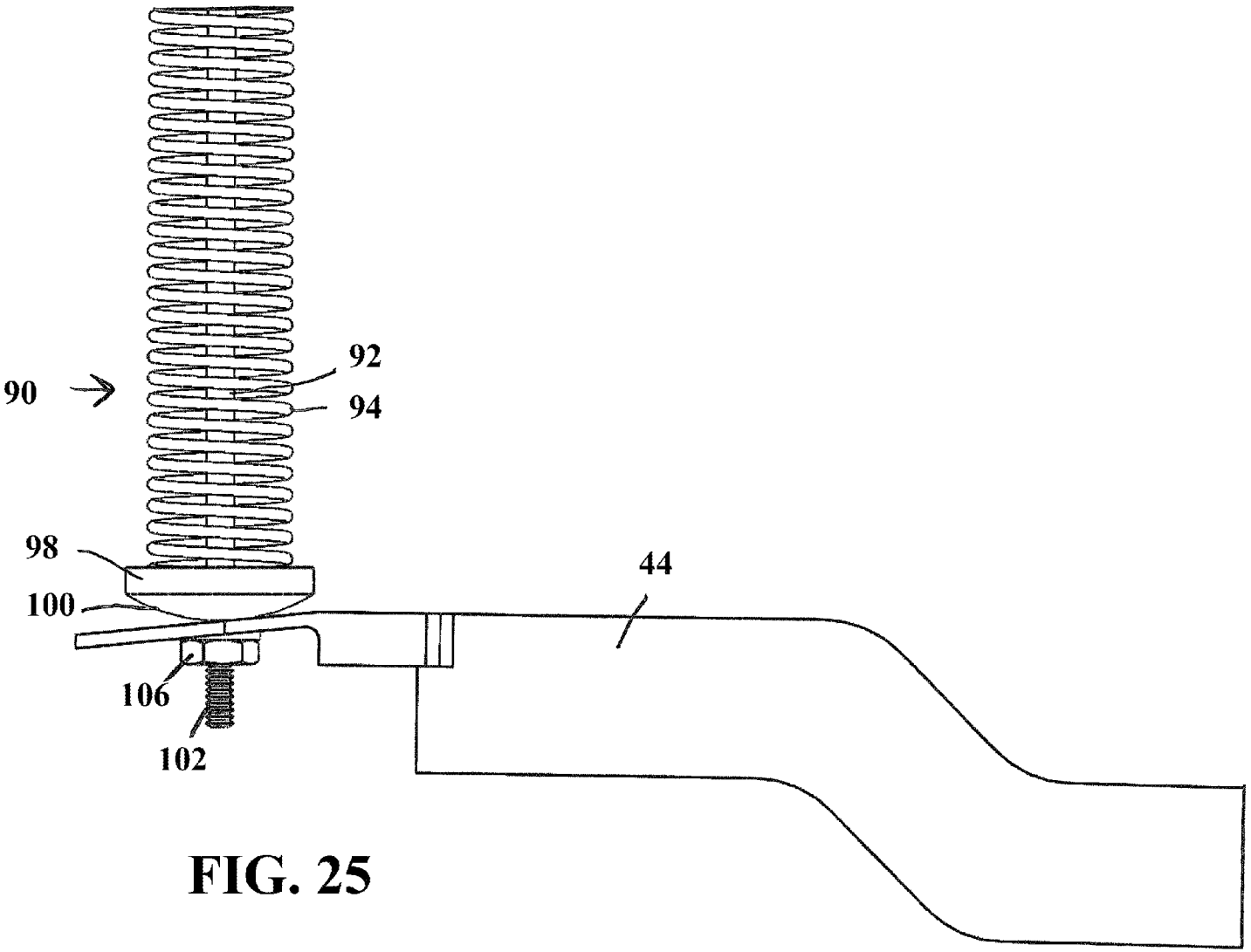
FIG. 25 is a perspective view of the lower portion of the embodiment of the waste disposal device shown in FIG. 18 with the spring in a position in which the lid is closed.
Figure 26:
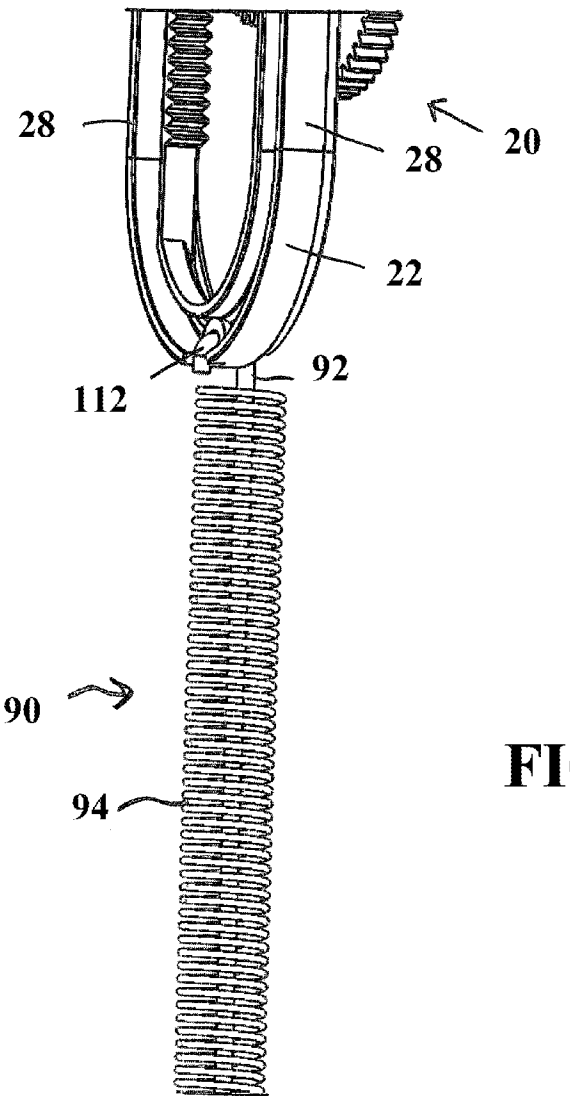
FIG. 26 is an enlarged view of another connection of the spring assembly to the rack gear assembly in the embodiment of the waste disposal device shown in FIG. 18.
Figure 27:
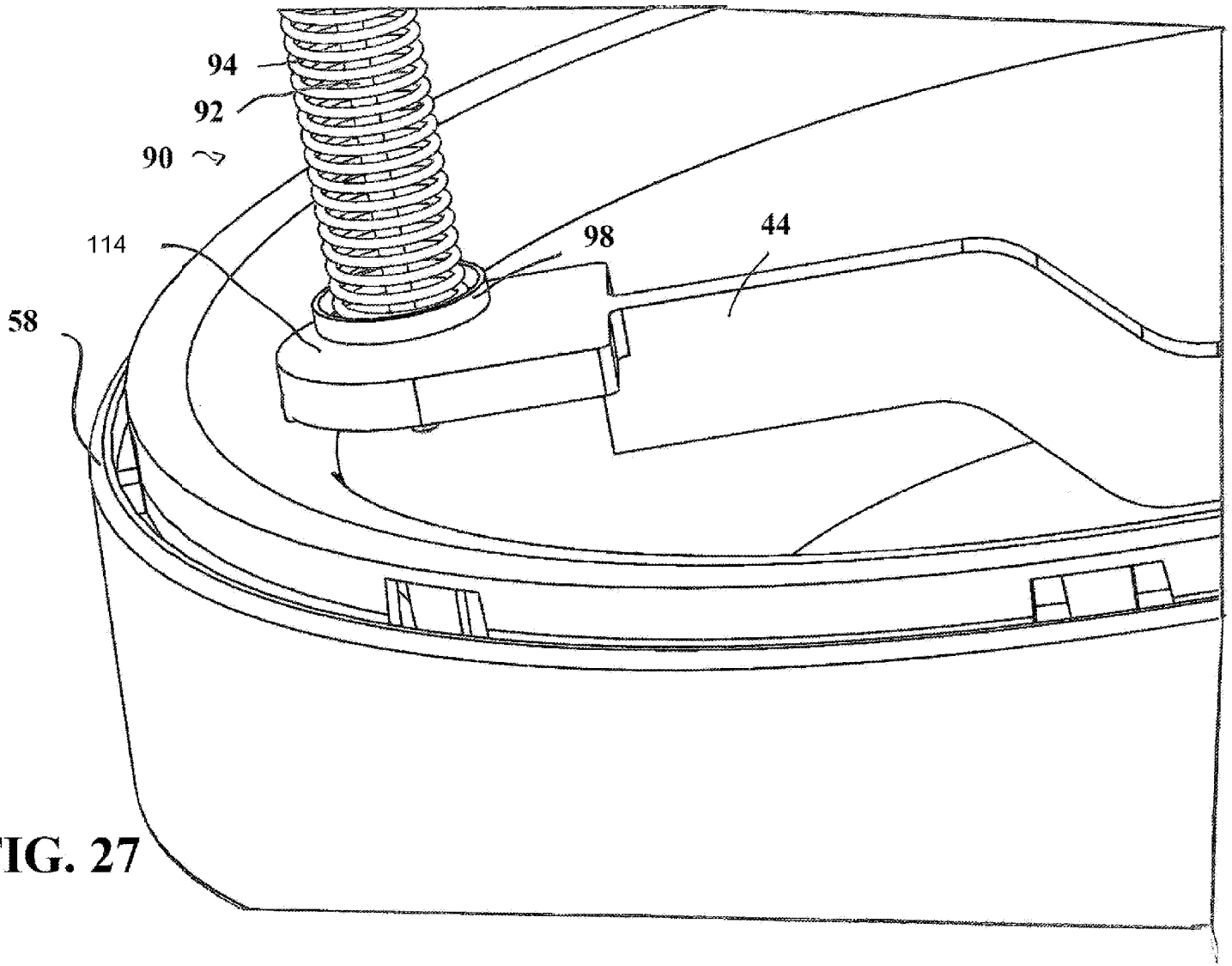
FIG. 27 is a perspective view of the lower portion of a variation of the embodiment of the waste disposal device shown in FIG. 18.
Figure 28:
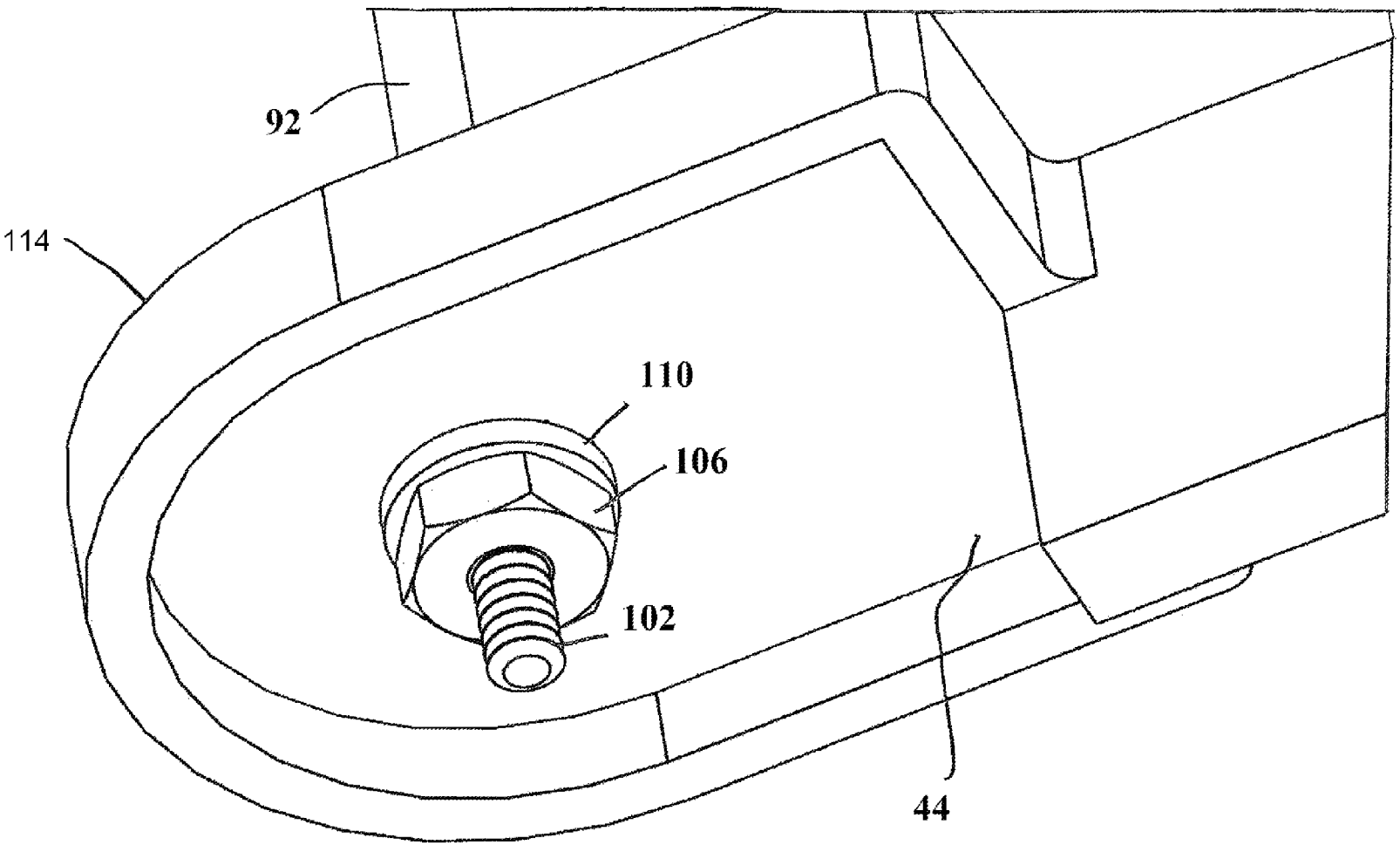
FIG. 28 is an enlarged view of the connection region of a horizontal actuating member and a spring assembly in the embodiment shown in FIG. 27.

A bottom area of the spring assembly 90 has a welded, slightly less than half moon (a portion of a sphere), rounded part 100 that is welded or otherwise fastened to the bottom area of the rod 92 (see FIGS. 23-25). The extension of this is a partially threaded rod 102 (see FIGS. 22 and 25) that goes through a slot 104 in the back slotted portion of the horizontal actuating member 44 (see FIGS. 22, 24 and 25). A nut 106 is threaded onto the rod 102 (see FIG. 25). The slotted area of the back portion of the horizontal actuating member 44 is shown as a flat as well as a tapered component. One purpose of this is to keep the vertical rod 92 straight when depressing the foot pedal 42. There is a small amount of play between the rounded part 100 and the tightened nut 106 (see FIG. 25). FIG. 22 also shows an optional washer 110. The nut 106 should not be over-tightened since there is just enough thread, but not enough to tighten the horizontal actuating member 44 and rod 92 to each other. Most often, some play will be needed for the mechanism to function properly.

When depressing the foot pedal 42, the rod 92 remains constantly (or at least substantially) straight upon depressing the foot pedal 42. An alternative tapered version will further assist in the prevention of deflection of the rod 92 during foot pedal depression and thus prevent any strain on the engagement of the rod 92 with the rack gear assembly 20.

FIGS. 19 and 24 show the position of the rod 92 when the lid 14 is open (foot pedal 42 depressed) and FIG. 18 shows the position of the rod 92 when the lid 14 is closed (foot pedal 42 released). Traveling or movement of the rod 92 along the slot 104 therefore assists the rod 92 in staying proud and straight. Each time the user further depress the foot pedal 42, the user invariably alters the rod 92 to the relative location of the slot 104 in the horizontal actuating member 44. As such, there is a certain fluid quality occurring that assists the rod 92 to remain straight and proud.

When the lid 14 is closed, or after releasing the foot pedal 42, the compression spring 94 is in a relaxed position and the waste in the bag or tubing 76 has been rotated. When the lid 14 is opened by stepping on the foot pedal 42, the spring 94 is compressed to cause tension to push up the rack gear assembly 20 and at the same time, does not unwind the waste in view of the disconnect of the rack gear assembly 20 and the twisting mechanism 16. Once again, upon releasing the foot pedal 42, the compression spring 94 returns to its uncompressed or original state and urges the lid 14 to close because the compression spring 94 pulls down on the rack gear assembly 20 because of the relaxation of the compression spring 94, thus turning the waste (bag), etc. (see the discussion above with respect to the embodiment shown in FIGS. 1-5). FIG. 18 shows a bag or tubing 76 with a twist or knot 78 while the lid 14 is closed. The twist or knot 78 will remain in place (not unwind) with the lid 14 open.

There are many ways to attach or fasten the rod 92 of the spring assembly 90 to the rack gear assembly 20. A 90 degree hooked portion 108 of the rod 92 (see FIG. 21) is attached to the U-shaped frame 22 of the rack gear assembly 20 using a nut 111 (see FIGS. 20 and 23). In another embodiment shown in FIG. 26, a 180 degree U-shaped hook 112 of the rod 92 engages a hole in the U-shaped frame 22 of the rack gear assembly 20 by looping through it, thus eliminating the need for the 90 degree version requiring a nut 111 to lock the rod 92 to the rack gear assembly 20. Obviously, there are other ways to engage the rod 92 into the rack gear assembly 20, and all are contemplated to be within the scope and spirit of the invention.

One such method, not shown, is to have the end of the top of the rod 92 be straight and threaded while a bottom central portion of the rack gear assembly 20, e.g., the U-shaped frame 22 or rack gear 26 thereof. could be machine threaded to accept the threaded top of the rod 92. For manufacture, the user would screw the rod 92 directly into the threaded portion of the rack gear assembly 20. For extra strength, the rack gear assembly 20 could have a metal threaded insert and could be "Insert Molded" directly at the point of injection molding of the rack gear assembly 20 of U-shaped frame 22 thereof. The rack gear 26 itself may also be threaded to accept the threaded end of the rod 92. Or, the U-shaped frame 22 or rack gear 26, or other part of the rack gear assembly 20, can be actually machined or dye cast of a metal substrate and the threads would be cast or machine threaded. Whether insert molded or made entirely of metal, the rod 92 would be securely engaged into the base of the U-shaped frame 22 of the rack gear assembly 20.

Referring now to FIGS. 27-30, a variation of the above embodiment relates to an alternative construction of the horizontal actuating member 44. As shown in FIGS. 27-30, the horizontal actuating member 44 does not include a slot 104, i.e., there is a fixed compression point between the horizontal actuating member 44 and the spring assembly 90. The rounded part 100 may be present (see FIG. 30) or eliminated in this embodiment (see FIG. 27). The retaining member 98 and/or the rounded part 100 may be attached, e.g., welded, to the rod 92.

Figure 29:
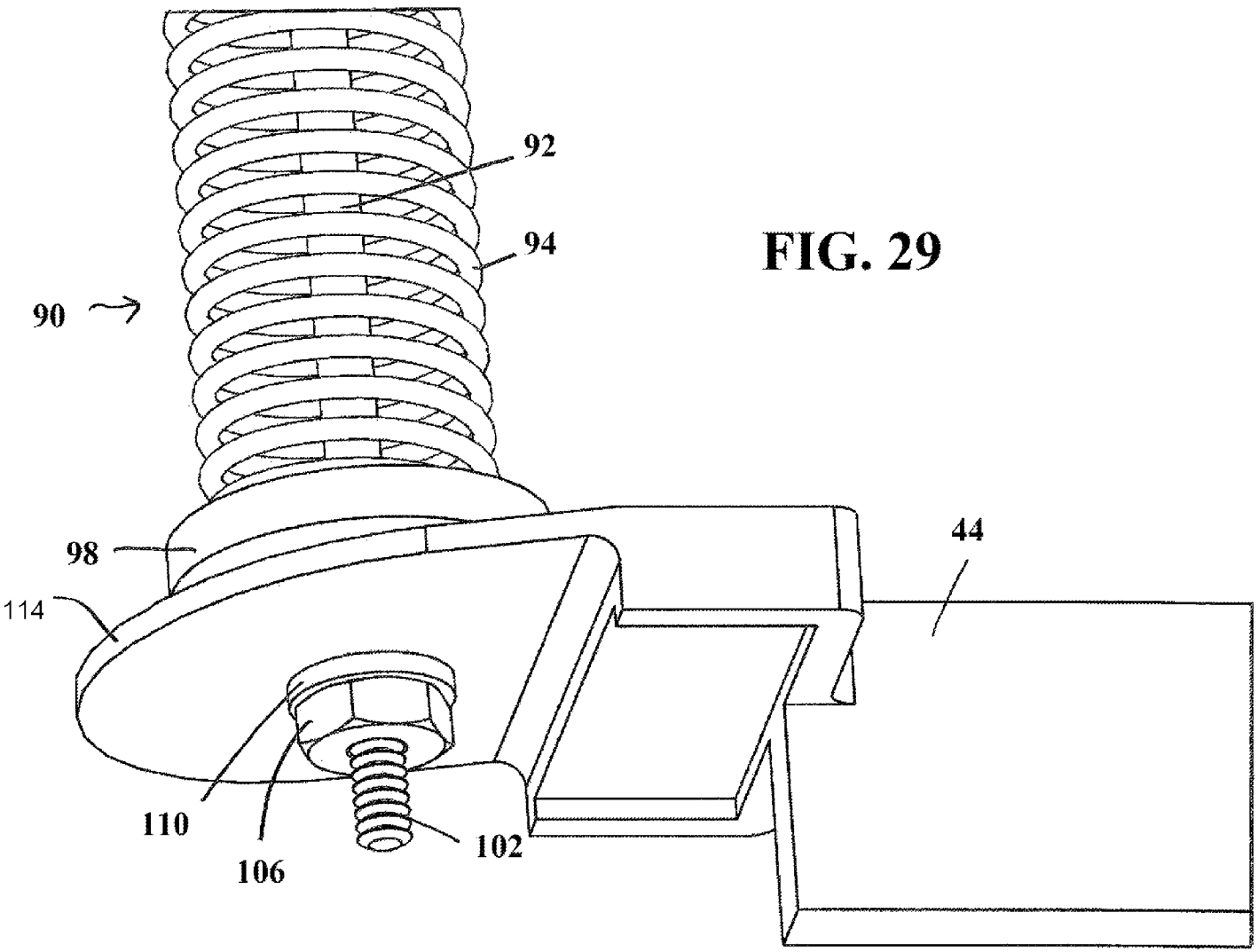
FIG. 29 is an enlarged view of the connection region of an alternate horizontal actuating member and a spring assembly similar to that shown in FIG. 27.
Figure 30:
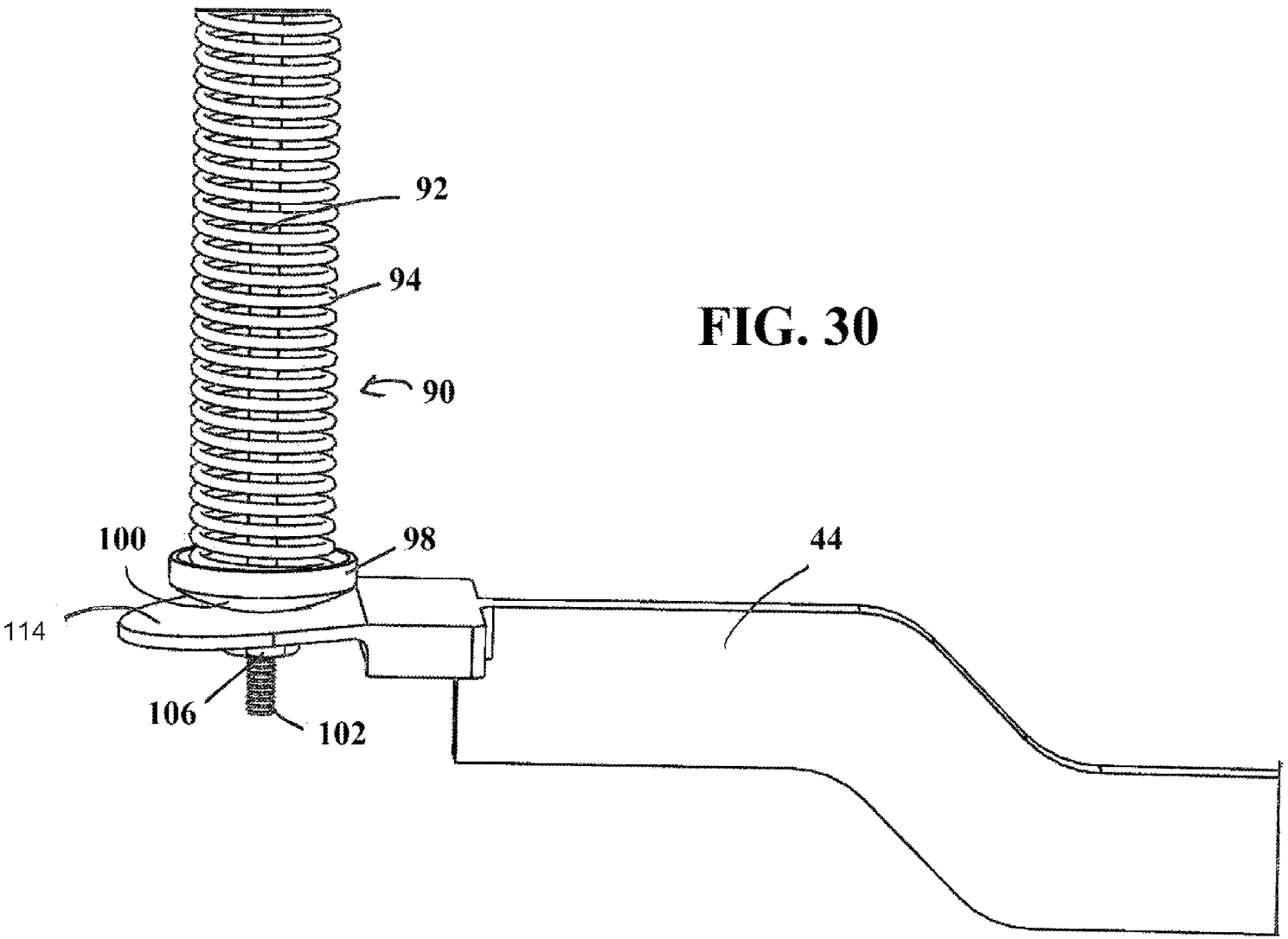
FIG. 30 is another enlarged view of the connection region of the horizontal actuating member and spring assembly shown in FIG. 29.

Thus, the horizontal actuating member 44 includes a hole in a flattened area 114 (at the end region opposite to the foot pedal 42), see FIGS. 29 and 30, through which the rod 92 passes, and a nut 106 and optional washer 110 that fasten the rod 92 to the horizontal actuating member 44. As noted above, the tightening of nut 106 should not be made too tight to allow for some play between the horizontal actuating member 44 and the rod 92. To prevent over-tightening, it is possible to provide just enough thread on the threaded rod 102 to tighten the nut 106 but not enough thread to over-tighten it. It is preferable to provide some play for the armature to function properly and optimally.

Further, in this embodiment, it may be beneficial to deflect the rod 92 when depressing the foot pedal 42. In doing so, the rod 92 would be deflected a tad, but it may not be that critical.

The inventions described above may be used with any number of different waste disposal devices, including waste disposal devices disclosed in U.S. patent application Ser. Nos. 12/172,715 filed Jul. 14, 2008, 12/172,758 filed Jul. 14, 2008 and 12/172,793 filed Jul. 14, 2008, and U.S. provisional patent application Ser. No. 61/362,159 filed Jul. 7, 2010, 61/362,183 filed Jul. 7, 2010, Ser. Nos. 61/366,221 filed Jul. 21, 2010, and 61/409,188 filed Nov. 2, 2010, all of which are incorporated by reference herein. A novelty of the invention with respect to some of the waste disposal devices disclosed in these applications is that the invention provides hands-free use of the waste disposal device. The spring, or other biasing member in the invention, pulls down the lid with the same force as a user would apply if they closed the lid with their hand. The spring closes the lid as its tension or compression is returned to rest, i.e., to its original, normal state, because the spring urges down, for example, a U-channel rack gear which, in turn, is brought into toothed engagement with gears that effect rotation of the waste or the bag or tubing around or above it thereby providing simultaneous closure of the lid and formation of a twist or knot in the bag or tubing above the inserted waste.

The spring, when provided in any of the embodiments disclosed herein or in those of these applications, is advantageous in that it allows for this hands-free operation. By contrast, in conventional waste disposal devices, even those with pedals, there is no spring whose force is used to effect rotation of a twisting mechanism, but rather a damper is usually provided or the lid is tilted forward a tad so as to allow gravity to close the lid. These techniques are believed to be inferior to the invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, although the rotation mechanism 18 is described above to rotate a twisting mechanism relative to a stationary support or cartridge which supports or retains a waste-containing member, it is conceivable that the same rotation mechanism can be arranged to rotate a support or cartridge which supports or retains a waste-containing member relative to a stationary twisting mechanism.

The invention claimed is:

1. A waste disposal device adapted to receive a waste-containing member, comprising:

a container defining a waste-receiving compartment having an opening;

a lid connected to said container, said lid having a first, closed position covering said opening of said container and a second, open position in which said opening is exposed;

a rotation mechanism arranged in said container to rotate the waste-containing member when present in said container, said rotation mechanism being arranged to rotate the waste-containing member only upon closure of said lid without manual handling of said lid and not upon opening of said lid, said rotation mechanism comprising at least one member coupled to said lid and arranged such that downward movement of said at least one member causes rotation of the waste-containing member; and a foot pedal assembly comprising a depressible foot pedal and a spring, said foot pedal assembly being arranged to cause both opening of said lid when said foot pedal is depressed and closure of said lid when a pressing force on said foot pedal is removed, said spring being arranged to be moved against its bias upon depression of said foot pedal and return to its original state when the pressing force is removed, and said spring being coupled to said at least one member of said rotation mechanism such that when said spring returns to its original state, said spring pulls said at least one member of said rotation mechanism downward and thereby causes closure of said lid coupled to said at least one member of said rotation mechanism and rotation of the waste-containing member.

2. The device of claim 1, wherein said at least one member comprises at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said spring being connected to said frame.

3. The device of claim 2, further comprising a fastening member for fastening an upper end region of said spring to said frame.

4. The device of claim 1, wherein said foot pedal assembly further includes a horizontal actuating member connected to said foot pedal at a first end region, a vertical actuating member movably connected at a second end region of said horizontal actuating member and a pivot pin connected to said horizontal actuating member between its ends.

5. The device of claim 4, wherein said spring extends alongside or around said vertical actuating member and is connected at its lower end region to said container and at its upper end region to said vertical actuating member.

6. The device of claim 4, wherein said vertical actuating member includes a mounting structure at a lower end region, further comprising a pivot pin that engages with said mounting structure and passes through an aperture in said horizontal actuating member to thereby pivotally connect said horizontal actuating member to said vertical actuating member.

7. The device of claim 1, wherein said container includes at least one transparent window that enables viewing of an interior of said container.

8. The device of claim 7, wherein said container includes an access door, one of said at least one window being arranged in said access door.

9. The device of claim 1, wherein said foot pedal assembly further includes a horizontal actuating member connected to said foot pedal at a first end region and said spring is a compression spring and is part of a spring assembly, said spring assembly further comprising a rod around which said spring is positioned, said rod being attached at a lower end region to said horizontal actuating member and at an upper end region to said rotation mechanism.

10. The device of claim 9, wherein said at least one member comprises at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said rod being connected to said frame.

11. The device of claim 10, wherein said rod includes a 90 degree portion which is passed through an aperture in said frame, further comprising a fastening member for fastening said 90 degree portion of said rod to said frame.

12. The device of claim 10, wherein said rod includes a 180 degree, hook portion which is passed through an aperture in said frame to thereby fasten said rod to said frame.

13. The device of claim 9, further comprising retaining members for retaining upper and lower ends of said spring.

14. The device of claim 9, wherein said rod includes a portion that extends through a slot in said horizontal actuating member, said rod being fixed to said horizontal actuating member in a manner to allow said portion to be movable in said slot.

15. The device of claim 9, wherein said rod includes a portion that extends through a hole in said horizontal actuating member, said rod being fixed to said horizontal actuating member.

16. A waste disposal device, comprising:

a container defining a waste-receiving compartment having an opening;

a lid connected to said container, said lid having a first, closed position covering said opening of said container and a second, open position in which said opening is exposed;

a support that supports a waste-containing member and enables rotation of the waste-containing member;

a rotation mechanism arranged in said container to rotate the waste-containing member when present in said container, said rotation mechanism being arranged to rotate the waste-containing member only upon closure of said lid without manual handling of said lid and not upon opening of said lid, said rotation mechanism comprising at least one member coupled to said lid and arranged such that downward movement of said at least one member causes rotation of the waste-containing member; and a foot pedal assembly comprising a depressible foot pedal and a spring, said foot pedal assembly being arranged to cause both opening of said lid when said foot pedal is depressed and closure of said lid when a pressing force on said foot pedal is removed, said spring being arranged to be moved against its bias upon depression of said foot pedal and return to its original state when the pressing force is removed, said spring being coupled to said at least one member of said rotation mechanism such that when said spring returns to its original state, said spring pulls said at least one member of said rotation mechanism downward and thereby causes closure of said lid coupled to said at least one member of said rotation mechanism and rotation of the waste-containing member.

17. The device of claim 16, wherein said at least one member comprises at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said spring being connected to said frame, further comprising a fastening member for fastening an upper end region of said spring to said frame.

18. The device of claim 16, wherein said foot pedal assembly further includes a horizontal actuating member connected to said foot pedal at a first end region, a vertical actuating member movably connected at a second end region of said horizontal actuating member and a pivot pin connected to said horizontal actuating member between its ends.

19. The device of claim 18, wherein said vertical actuating member includes a mounting structure at a lower end region, further comprising a pivot pin that engages with said mounting structure and passes through an aperture in said horizontal actuating member to thereby pivotally connect said horizontal actuating member to said vertical actuating member.

20. The device of claim 16, wherein said spring is a compression spring and is part of a spring assembly, said spring assembly further comprising a rod around which said spring is positioned, said rod being attached at a lower end region to said horizontal actuating member and at an upper end region to said rotation mechanism.

21. The device of claim 20, wherein said at least one member comprises at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said rod being connected to said frame.

22. A waste disposal device adapted to receive a waste-containing member, comprising:

a container defining a waste-receiving compartment having an opening;

a lid connected to said container, said lid having a first, closed position covering said opening of said container and a second, open position in which said opening is exposed;

a rotation mechanism arranged in said container to rotate the waste-containing member when present in said container, said rotation mechanism being arranged to rotate the waste-containing member only upon closure of said lid without manual handling of said lid and not upon opening of said lid, said rotation mechanism comprising at least one member coupled to said lid and arranged such that downward movement of said at least one member causes rotation of said the waste-containing member; and a foot pedal assembly comprising a depressible foot pedal, a spring assembly and a horizontal actuating member connected to said foot pedal at a first end region, said foot pedal assembly being arranged to cause both opening of said lid when said foot pedal is depressed and closure of said lid when a pressing force on said foot pedal is removed, said spring assembly being arranged to be moved against its bias upon depression of said foot pedal and return to its original state when the pressing force is removed, and said spring assembly being coupled to said at least one member of said rotation mechanism such that when said spring returns to its original state, said spring assembly pulls said at least one member of said rotation mechanism downward and thereby causes closure of said lid coupled to said at least one member of said rotation mechanism and rotation of the waste-containing member, said spring assembly comprising a rod attached at first end region to said horizontal actuating member and attached at a second end region to said at least one member of said rotation mechanism, and a spring extending alongside or around said rod and which is retained for compression and tension.

23. The device of claim 22, wherein said at least one member comprises at least one rack gear, said rotation mechanism further comprising:

a gear assembly having a first gear in meshing engagement with said at least one rack gear and a second, drive gear in meshing engagement with the waste-containing member and which is rotationally coupled to said first gear; and a frame pivotally coupled to said lid at an upper end region thereof, said at least one rack gear being arranged on said frame, said rod being connected to said frame.

24. The device of claim 23, wherein said rod includes a 90 degree portion which is passed through an aperture in said frame, further comprising a fastening member for fastening said 90 degree portion of said rod to said frame.

25. The device of claim 23, wherein said rod includes a 180 degree, hook portion which is passed through an aperture in said frame to thereby fasten said rod to said frame.

26. The device of claim 22, further comprising retaining members for retaining upper and lower ends of said spring.

27. The device of claim 22, wherein said rod includes a portion that extends through a slot in said horizontal actuating member, said rod being fixed to said horizontal actuating member in a manner to allow said portion to be movable in said slot.

28. The device of claim 22, wherein said rod includes a portion that extends through a hole in said horizontal actuating member, said rod being fixed to said horizontal actuating member.

* * * * *

UNITED STATES PATENT AND TRADEMARK OFFICE

CERTIFICATE OF CORRECTION

PATENT NO. : 8,235,237 B1
APPLICATION NO. : 13/161764
DATED : August 7, 2012
INVENTOR(S) : David M. Stravitz It is certified that error appears in the above-identified patent and that said Letters Patent is hereby corrected as shown below:

Column 15, line 39, after "rotation of", delete "said".

Signed and Sealed this
Eleventh Day of September, 2012

David J. Kappos

David J. Kappos
*Director of the United States Patent and Trademark Office*